US007093652B2

(12) United States Patent
Gray et al.

(10) Patent No.: US 7,093,652 B2
(45) Date of Patent: Aug. 22, 2006

(54) PLUNGER WITH MULTIPLE JACKETS

(75) Inventors: William R. Gray, 1801 Rolling Wood, Huntsville, TX (US) 77340; James H. Holt, Conroe, TX (US)

(73) Assignee: William R. Gray, Huntsville, TX (US)

( * ) Notice: Subject to any disclaimer, the term of this patent is extended or adjusted under 35 U.S.C. 154(b) by 423 days.

(21) Appl. No.: 10/077,341

(22) Filed: Feb. 15, 2002

(65) Prior Publication Data

US 2003/0155116 A1 Aug. 21, 2003

(51) Int. Cl.
*E21B 33/12* (2006.01)

(52) U.S. Cl. ..... 166/106; 166/101; 166/105; 166/242.6

(58) Field of Classification Search ..... 166/68, 166/68.5, 105, 106, 108, 110, 101, 242.6
See application file for complete search history.

(56) References Cited

U.S. PATENT DOCUMENTS

| | | | | |
|---|---|---|---|---|
| 3,424,066 A | | 1/1969 | Moore | |
| 3,424,093 A | | 1/1969 | Moore, Jr. | |
| 3,953,155 A | | 4/1976 | Roeder | |
| 4,239,458 A | * | 12/1980 | Yeatts | 417/60 |
| 4,410,300 A | | 10/1983 | Yerian | |
| 4,531,891 A | | 7/1985 | Coles, III et al. | |
| 4,898,235 A | * | 2/1990 | Enright | 166/64 |
| 5,427,504 A | | 6/1995 | Dinning et al. | |
| 6,045,335 A | | 4/2000 | Dinning | |
| 6,176,309 B1 | * | 1/2001 | Bender | 166/68 |
| 6,200,103 B1 | | 3/2001 | Bender | |
| 6,209,637 B1 | | 4/2001 | Wells | |
| 6,554,580 B1 | * | 4/2003 | Mayfield et al. | 417/56 |

OTHER PUBLICATIONS

Petrovalve USA; Petrovalve Plus Rod Pump Valve Brochure; no date; pp. 1–4.

* cited by examiner

*Primary Examiner*—Zakiya Walker
(74) *Attorney, Agent, or Firm*—The Matthews Firm

(57) ABSTRACT

A plunger for use in tubulars in wells which produce fluids and/or gases under variable pressure. The plunger has at least two separate jackets comprised of segments mounted about one body or bodies joined by a connector, which collectively have increased sealing, holding, and lifting capabilities. A inner turbulent or labyrinth-type seal is accomplished by circumferential grooves on the core and/or fingers which project inwardly from the underside of the segments. The plunger body may also have an internal passage to facilitate more rapid descent, and a simplified stopper housed inside a chamber which is actuated when the plunger reaches a well stop or well bottom and which is held in a closed position by the build up of pressure below the plunger. When the pressure inside the tubulars above the plunger is reduced, the plunger and fluids move upwardly to the surface.

87 Claims, 11 Drawing Sheets

PLUNGER WITH MULTIPLE JACKETS

BACKGROUND OF THE INVENTION

1. Field of the Invention

The present invention relates to improvements in plungers used in a gas/fluid lift system in wells producing both fluids and gases, such as petroleum and natural gas, under variable pressure to facilitate the lifting of fluids from a subterranean reservoir to the surface through a well conduit or tubulars. Plungers of this type are designed to minimize the downward flow of fluids as well as the upward flow of gases beneath the plunger as the plunger travels upwardly to the surface. More specifically, the gas plunger invention concerns an improved plunger with at least two separate internal and external sealing apparatuses preferably being separate jacket assemblies which collectively have increased sealing, holding, and lifting capabilities in comparison to the single jacket assembly heretofore described. This is accomplished by joining at least plunger bodies together by means such as a double-ended connector, or providing an elongated core with at least two longitudinally divided, separate sealing apparatuses.

The plungers with dual jacket sealing assemblies may also include improvements in the internal and external sealing of the apparatus. The external sealing means or apparatus is typically comprised of a plurality of segments, which collectively forms a jacket assembly that sealingly and slidingly engages the well tubulars. A turbulent inner seal is accomplished by sealing means such as circumferential grooves on the inner core and/or fingers which project inwardly from the segments toward the inner core which may or may not be grooved. Alternatively, the inner surface of the segments may have furrows and there may be raised bands on the core which also effects a turbulent inner seal. The circumferential grooves and/or fingers, or the bands and/or furrows, provide a tortuous path of flow that deflects escaping gas streams and/or fluids, promotes turbulence in the manner of a labyrinth seal, and has gas sealing capabilities. These improved sealing elements are also the subject of separate, concurrently-filed applications invented by the same inventors.

Another further and alternative improvement of the multi-jacket plungers concerns a simplified sucker rod and stopper, valve-like assembly housed inside a plunger chamber which is used to regulate and restrict the flow of fluids and gases through the internal passage of the plunger. Such an internal passage allows plungers to descend to the well bottom more rapidly than plungers without internal passages so that flow occurs only during the downward cycle or descent of the gas plunger. The simplified stopper is also the subject of separate, concurrently-filed applications invented by the same inventors.

2. Description of the Prior Art

Differential gas pressure operated pistons, also known as plungers, have been used in producing subterranean wells where the natural well pressure is insufficient to produce a free flow of gas, and especially fluids, to the well surface. A plunger lift system typically includes tubulars placed inside the well conduit, which extend from the well reservoirs of the well to the surface. The tubulars have a well valve and lubricator at the top and a tubing stop and often a bumper spring or other type of spring assembly at the bottom. The cylindrical plunger typically travels between the bottom well stop and the top of the tubulars. The well is shut in for a selected time period which allows pressures to build up, then the well is opened for a selected period of time. When the well valve is opened, the plunger is able to move up the tubulars, pushing a liquid slug to the well surface. When the well valve is later closed, the plunger, aided by gravity, falls downwardly to the bottom of the tubulars. Typically, the open and closed times for the well valve are managed by a programmable electronic controller.

When the plunger is functioning properly, fluids accumulate and stay above the plunger and pressurized gases and/or fluids below the plunger are blocked from flowing up, around, and through the plunger. As a result, the plunger and accumulated fluids are pushed upwardly. The prior art devices use a variety of external, and sometimes internal, sealing elements which allow the plungers to block the upward flow of gases and slidingly and sealably engage the tubulars, which accomplishes the lifting of fluids to the surface depending upon the variable well pressures. Examples of prior art gas operated plungers include those disclosed in U.S. Pat. Nos. 5,427,504 and 6,045,335 (the '504 and '335 patents respectively). The prior art plunger of the '504 patent features mechanical sealing which is accomplished by a single set of segments that are biased outwardly against the tubulars by springs. The build up of internal pressure is accomplished by a flexible, elastomeric seal placed beneath the segments. However, because such resilient compounds, like rubber, do not last for extended periods of time in the harsh well environment, problems with inner sealing develop and the plunger must be taken out of service for time-consuming seal replacements. Further, if the inner spring member which assists in biasing of the segments becomes detached or lost, sealing problems can result.

In contrast, the prior art plunger of the '335 patent has upper and lower sets of segments whose sides are juxtaposed with respect to each other and collectively work together. The segments are biased outwardly against the tubulars by springs and the build up of internal pressure. The sealing element therein consists of a rigid inner ring member surrounding the intermediate portion of the piston body, which is positioned between the piston body and between the inner surfaces of each set of cylindrical segments, which cooperate to slidingly engage the rigid ring member and create an inner seal. However, the segments of this design can be prone to leakage.

Other prior art plungers which have externally grooved surfaces, and which lack outer sealing elements or segments are, for example, disclosed in U.S. Pat. Nos. 4,410,300 and 6,200,103. These external grooves deflect the escaping gas streams and promote turbulence in the manner of a labyrinth seal and have gas sealing capability. However, the grooves are prone to structural failure due to external wear and erosion due to contact with the tubulars, and these plungers can also become jammed within the tubulars because these types of plungers do not have the capability of contracting radially inward, as do the plungers with cooperating mechanical sealing segments. The improved plunger design incorporates the concept of a labyrinth seal in its internal sealing elements.

Other examples of prior art gas operated plungers include those with internal bores or passages to speed the descent of the plungers. These plungers have a variety of valve closure members which seal the internal bore, and the prior art valve closure members are often spring loaded and work in conjunction with long rods which typically extend downwardly through the bore to unseat the valve closure member, as disclosed in the '504 and '335 patents. The design of the piston disclosed in the U.S. Pat. No. 6,045,335 patent includes a complicated valve mechanism which requires a unit to capture the piston at the surface and requires a long rod which moves downwardly through the plunger bore to disengage and unseat the valve closure member, and to open the internal valve. However, this rod used to reopen the valve assembly is prone to damage and bending if the rod and plunger bore become even partially unaligned, requiring expensive and time-consuming repair or replacement. Additionally, this type of plunger also requires expensive and customized installation of equipment at the well surface such as spring loaded stops to accomplish disengagement of the valve closure member. In contrast, the plunger of the '504 patent has a bypass valve with a ball-shaped closure member and a spring loaded rod activator, or shock spring, which pushes the ball up into the valve seat to seal off the flow path. The spring loaded rod activator opens the valve after the plunger reaches the lubricator at the top of the well and the pressures above and below the plunger are equalized. Alternative embodiments of the improved plungers feature either a chamber and stopper in the lower plunger body, for example in a modified end cap, in the case of connected plungers. In plungers having a single, elongated body, the chamber is located near the lower end of the plunger, typically in a modified end cap. The improved stopper assembly, which is housed in the chamber, seals off the inner passage in a simplified manner. The stopper stem and stopper head is pushed up into the chamber when the plunger bottom contacts the well stop means, and the stopper is held up against the opening of the flow passage by the fluid and/or gas pressure below the plunger. This simplified and improved design dispenses with the need for complicated moving parts which actuate the closure means, and eliminates the need for expensive equipment at the well head which is used to unseat the closure means.

The improved plunger inventions seek to dispense with the problems of the prior art such as erosion, leakage, erratic or unsafe operation, malfunctions, and costly replacements or repairs. Many other objects and advantages of the inventions, besides substantially trouble free operation, will be apparent from reading the description which follows in conjunction with the accompanying drawings.

SUMMARY OF THE PRESENT INVENTION

The present invention provides a plunger for use in a gas/fluid lift system in tubulars in wells producing both fluids and gases under variable pressure. The plunger assists with the build up of pressure between the subterranean reservoir and the surface by having an inner seal and an external sliding and variable holding seal with adjacent well tubulars. The inner and external seals restrict the upward flow of the fluids and/or gases. This causes an increase in the well pressure below the plunger and facilitates the upward lifting of the plunger and fluids from the reservoir to the surface when pressure is reduced above the plunger, such as at the well head. The improved plunger comprises a first body and a second body slidingly engageable within the tubulars which is capable of movement up and down the tubulars. Each plunger body has a top end, a bottom end, and an inner core within each body for internal sealing. Each body has at least one separate flexible jacket having a plurality of segments mounted about each core. A connector is disposed between the first and second bodies and joins the bodies. Alternatively, the plunger has an elongated inner core within the body for internal sealing, and at least two separate sealing means, mounted about said core. There is also a flow path for fluids and/or gases between said core and the inner surface of each sealing means. The separate sealing means may be in the form of separate jacket assemblies such as those formed by segments. This enhances the plunger's internal and external sealing abilities as well as the external holding ability against the tubulars. The segments which collectively form the jacket assembly are slidingly and sealingly engageable with the insides of the well tubulars, based upon the pressure effected between the inner surface of the jacket and the core. The jacket has the largest diameter of the plunger when the segments are in an expanded radial position. The segments typically have a convex outer surface and also have an inner surface which is typically concave. However, the core of the plunger could be square, triangular, or of another geometric shape, in which case the inner surfaces of the segments could be flat, or of any other corresponding geometric shape.

In a preferred embodiment of the plunger, there is also an inner sealing means such as at least one rigid finger which projects radially inward from the underside of each segment toward the core, with the fingers of the adjacent segments collectively cooperating to encircle the core. Preferably, there are a plurality of fingers on the undersides of each segment. The fingers are normally separated from the core especially when the segments, collectively the jacket, are pushed radially outward. This creates a path of flow for gases and/or liquids and the fingers collectively create a tortuous path of flow between the core and the segment undersides and effect a turbulent inner seal. When the segments making up the jacket are pushed to their most radially inward position, the fingers touch the core and cause a complete inner seal. In another embodiment of the plunger, the core has at least one circumferential groove on its surface, and more preferably a plurality of grooves. This also creates a tortuous path of flow between the core and the jacket underside and effects an inner seal. In another embodiment, the plunger has both grooves and fingers, and the fingers are correspondingly located to fit into the grooved portions of the core. This design creates an even more tortuous path of flow for fluids and gases which effects an inner seal and creates an increased surface area between the segments and core. The increased surface area also has the effect of increasing the internal plunger pressure, i.e., the pressure between the core and the jacket assembly, and energizes the segments, pushing the segments radially outward toward the well tubulars. This preferred design also prevents detachment and/or loss of the segments if the retainer rings, explained below, fail because the segments will be held in place by the finger-groove interface and by the outer well tubulars. This design provides for increased functionality and seeks to minimize expensive and time consuming fishing operations to retrieve dislocated parts.

An alternate embodiment also has at least one biasing means, which is typically a spring, between the underside of each segment and the core to outwardly bias each segment and to achieve inward and outward radial rebounding of the segments from the inner core. The preferred embodiment also has recessed spaces, or blind holes, in the core or core grooves and/or the fingers which hold the biasing means in place between the core and segments and prevent displacement and loss of the biasing means. The preferred embodiment typically also has retaining means such as retaining rings which limit the outward radial movement of the segments/jacket assembly. In plungers with both fingers and grooves, at least one of the outside edges of the grooves will be angularly reduced to allow installation of segments with projecting fingers into the grooves of the core and allows the end of the segments to be installed underneath the retaining rings.

In yet another embodiment of the invention, the plunger has an internal passage which extends partway through the body, or through the entire axis of the plunger, to facilitate more rapid descent of the plunger to the bottom of the well or the well stop means. These plungers also have a top end and a bottom end with at least one opening at or near the top and the bottom end and may have a plurality of radial ports which connect to the bore to increase the flow rate and to facilitate even more rapid descent of the plunger. The preferred embodiment has a plurality of radial ports near the top end and bottom end. These plungers further have a chamber in a modified end cap near the bottom end which houses a closure means such as a plunger stopper. The chamber connects to the internal passage at the roof and connects to the stem bore in the floor of the chamber. The plunger stopper has a top end which has a shape similar to that of the roof, or upper chamber area, and has a stem attached to the bottom end which extends downward through and protrudes outwardly from a bore opening in the bottom end. When the stem engages the bottom well stop means upon descent, the closure means such as a stopper, is pushed upwardly against the roof of the chamber, thereby sealing off the inner flow passage and restricting the upward flow of fluids and/or gases in order to build up pressure below the plunger. The improved design of this closure means, or stopper, operates without springs or catches, yet still holds the stopper against the roof of the chamber, and has no long sucker rod to bend. Instead, the pressure build-up below the plunger keeps the plunger stopper engaged against the roof of the chamber. The simplified bore sealing means also reduces the amount of time needed for costly and time-consuming repairs and replacements and dispenses with the need for expensive and customized devices at the surface that unseat the prior art closure valves.

The preferred embodiments of this invention may also have the previously described advantages of the rigid fingers, the grooved core, the spring recesses, and the reduced edge of the core groove. In another preferred embodiment of the invention, the top end of the closure means, such as the plunger stopper, also has a stem which is pushed upward into the inner passage above the chamber roof to further seal off the inner passage.

BRIEF DESCRIPTION OF THE DRAWINGS

Details of this invention are described in connection with the accompanying drawings that bear similar reference numerals in which.

DESCRIPTION OF THE PREFERRED EMBODIMENTS

Figure 1:
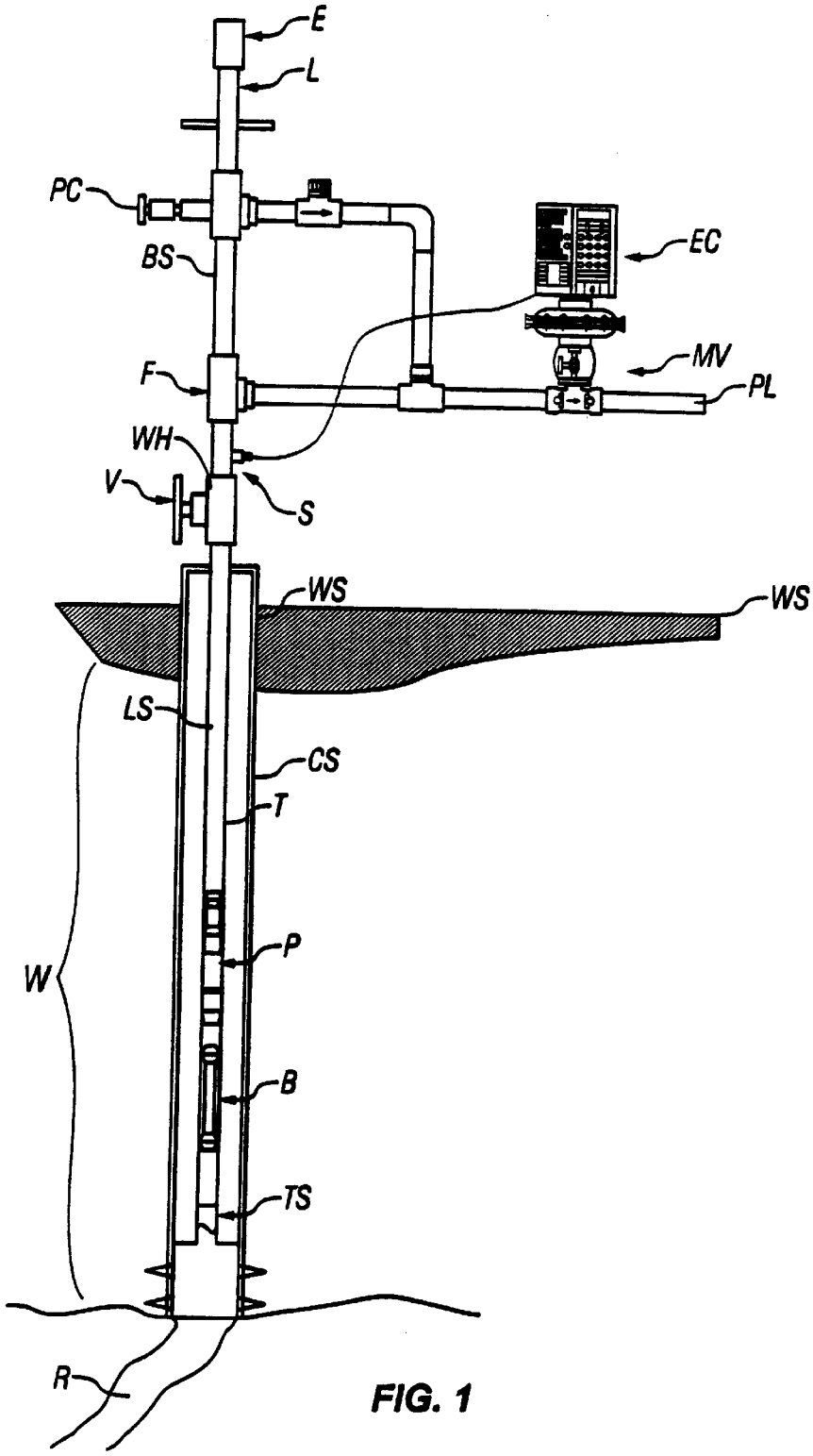
FIG. 1 is a schematic representation of an operating well and production of the well by utilizing a gas operated plunger according to an embodiment of the invention.

Referring first to FIG. 1, there is shown a producing well W for producing hydrocarbon fluids from a subterranean reservoir R. The well may be of the horizontal or vertical variety. The plunger pump P is preferably used in wells where the gas pressure alone is insufficient to produce the flow of liquids or the significant flow of fluids at the surface. In these situations, hydrocarbons from such wells cannot be recovered except through the installation of considerably expensive conventional or submersible pump units which require daily inspection and maintenance. Similarly, in wells producing primarily gas, the gas production may be substantially impaired by fluids, whether hydrocarbons or salt water, which accumulate in the bottom of the well. In either event, it is desirable to remove fluids from the bottom of such wells without installing conventional pumping units. Typically, one or more well conduits extend from the subterranean reservoir R to the well surface WS. In the preferred embodiment, there is a casing string CS, at the upper end of which is a well head WH, and a tubular string T, also known as "tubulars." Tubulars T is a generic term used to define the variety of tubes and tubular members, such as cement casings, conduits, and tubing and tubing string, which can also be referred to as the production string, which can be made from a variety of materials such as plastic, metal, and concrete. Tubulars line the well surface and can also be placed inside or on the outside of other tubulars. In any event, the tubulars are the well channels through which fluids from the subterranean reservoir R are raised to the surface. Near the bottom of the tubulars is a tubing stop means TS mounted in any suitable manner. The tubing stop means or mechanism TS may be relocated by wire line or other operations at different depths as well conditions change. The tubing stop TS preferably incorporates a bumper spring B of some type for stopping downward movement of a plunger type pump unit P, which is slidably and sealably disposed in the tubulars T and which will be described in greater detail hereafter. At the well surface WS is a master cutoff or motor operated valve MV suitably attached to the tubing string T to entirely block the flow of fluids from the tubulars T as desired. This arrangement further allows retrieval of the plunger pump P for inspection or repair. Above the valve V is a flow tee F and a lubricator L closed at its upper end by detachable end cap E. A bumper sub BS is usually placed therein with a spring (not shown) which is engageable by the plunger pump P when rising through the tubulars T to stop movement of the plunger P and to cushion the shock created thereby. Connected to the flow tee F is a production or pay line PL in which is installed a motor control valve MV. An electronic controller EC is provided for operating the control motor valve MV. The electronic controller EC is also connected to a tubing plunger sensor S for sensing the pressure within the wellhead WH. A plunger catching device PC may also be attached to the tubing string T above valve V.

Initially, the plunger P is placed in the tubulars through the lubricator sub L. This is done by removing the cap E while the valve V is closed. Then the cap E is replaced, the valve V opened, and the plunger P is allowed to gravitate or fall to the bottom of the well through the tubulars T. Although the sealing means, such as a jacket 100 made of segments, e.g., 46, 47, 48, 49, is biased outwardly for sliding and sealing engagement with the interior of the tubulars T, there is a small amount of leakage around the outside of the jacket assembly 100 and through the edges of the sealing segments 46, 47, 48, 49. This permits the plunger P to fall under its own weight toward the bumper spring B which will arrest its downward movement. When this occurs, the motor valve MV is closed and a time sequence is initiated by the controller EC. Additional fluids enter the tubulars T and the gas and/or fluid pressure begins to build. The controller EC is programmed to keep the motor valve MV closed until substantial fluids have entered the tubulars T and sufficient gas pressure has built up within the well. The amount of time necessary will be different for every well and may change over the life of the well. After a predetermined amount of time, the controller EC opens the motor valve MV, which substantially reduces the pressure above the plunger P. Consequently, the accumulated gas pressure therebelow forces the plunger P, and the fluids trapped thereabove, upwardly through the conduit or tubulars T, through the flow tee F, the valve V and the pay line PL for production of the well. As the plunger P is propelled upwardly through the tubulars T by pressure, it passes through the valve V, and is sensed by the sensor S and eventually movement thereof is arrested by a spring (not shown) in the lubricator sub L. When the plunger P is detected by the sensor S, a signal is transmitted to the controller EC which initiates closure of the motor valve MV. Thereafter the plunger P is allowed to again gravitate or fall to the bottom of the well so that this cycle can be repeated.

In describing the specific embodiments herein which were chosen to illustrate the invention, certain terminology is used which will be recognized as employed for convenience and having no limiting significance. For example, the terms "upper," "lower," "top," "middle," "bottom," and "side" refer to the illustrated embodiment in its normal position of use. The terms "outward" and "inward" will refer to radial directions with reference to the central axis of the device. Furthermore, all of the terminology defined herein includes derivatives of the word specifically mentioned and words of similar import.

Figure 2:
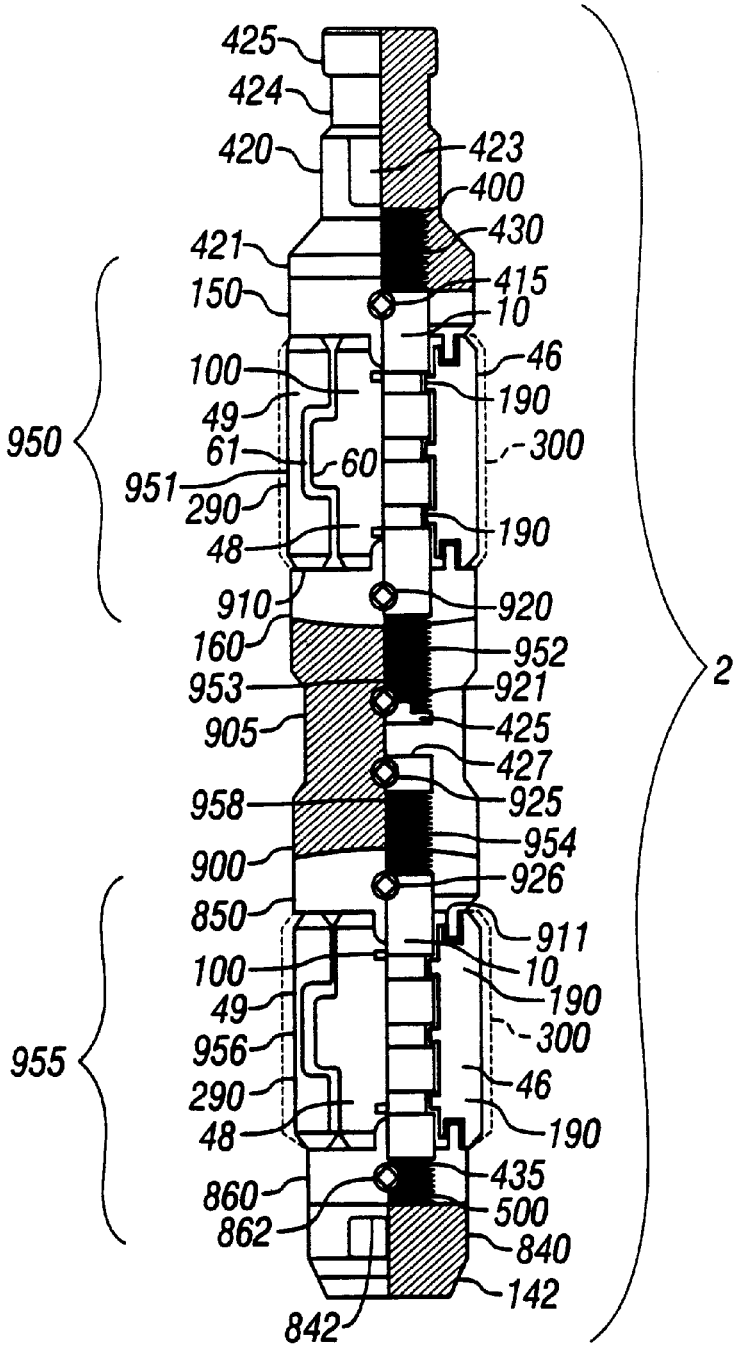
FIG. 2 is an external with cross sectional view of a plunger with two sealing assemblies which are joined by a connector.
Figure 4:
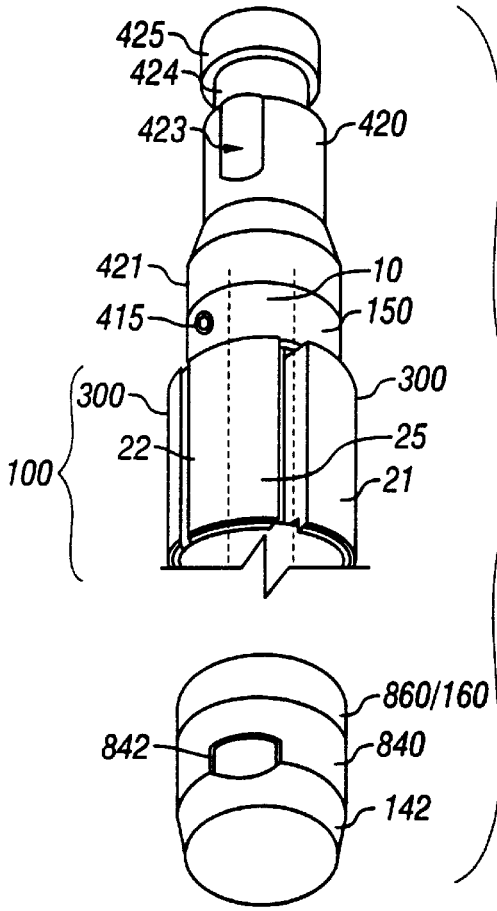
FIG. 4 is an external view of part of a plunger with one type of segment forming a jacket assembly.
Figure 6:
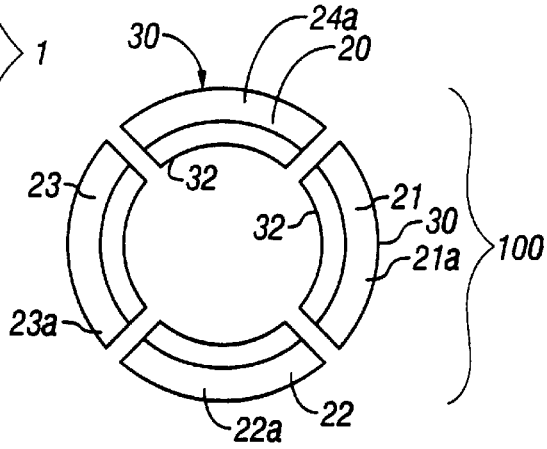
FIG. 6 is a top inner, perspective view of the sealing segments of FIGS. 4–5.
Figure 5:
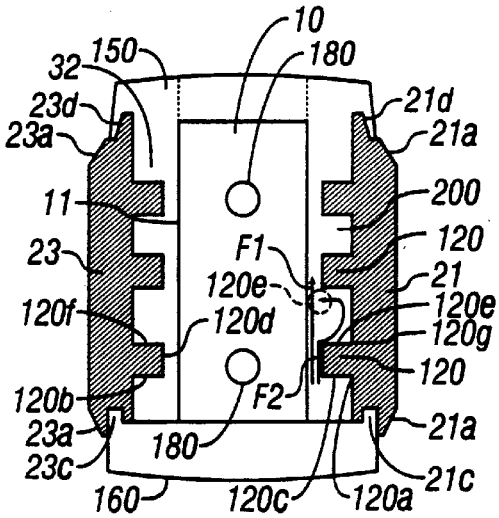
FIG. 5 is an upper end view of the four segments of the embodiment of FIG. 4.
Figure 7:
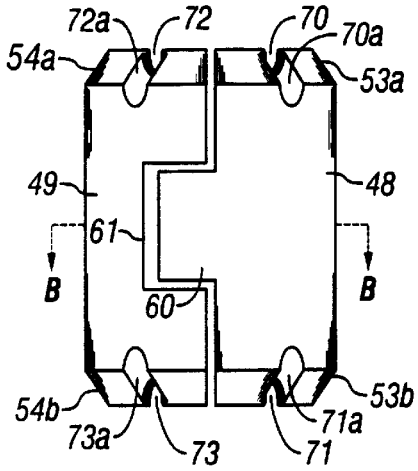
FIG. 7 is a longitudinal view of two of the four cooperating segments which form one type of jacket assembly for use with the preferred embodiments of FIGS. 2, 3.

FIG. 1 illustrates the operations of the improved plungers in a plunger lift system and FIGS. 2–27 illustrates preferred embodiments of the invention. FIG. 2 shows the first embodiment of the improved plunger 2, which has a first body 950 and a second body 955, joined by a connector 900, which is slidingly engageable within the well tubulars T. The entire plunger 2 is typically made of metal or metal alloys, but could also be made, in part, of other rigid materials, such as those known in the art, like plastic, graphite, ceramics, or hard rubber. Each body 950, 955 has an inner core 10 for internal sealing which may be solid or hollow. The core 10, also known as a mandrel, is typically cylindrical or substantially cylindrical and typically has the smallest diameter of the plunger. However, the core 10 could also be square, triangular, rectangular, or of another shape. The core 10 is surrounded by external sealing means such as several segments, with the preferred embodiment having four segments, e.g., 20, 21, 22, and 23, see FIGS. 4–6, or, e.g., 46, 47, 48, and 49, see FIGS. 7–10, around each core 10, which together form a flexible jacket assembly 100. As in FIG. 4, there is a flexible jacket assembly 100 surrounding or mounted about the core 10. The preferred embodiment has four segments 20, 21, 22, and 23, which collectively form a flexible jacket assembly 100. Referring now to FIGS. 4, 5 and 6, each segment preferably has a substantially convex outer shape 30 and a substantially concave inner surface 32, like that of a semicircular arch. Each segment 20–23 or 4649, has substantially the same width and curve so that several segments can be placed side by side to form a flexible jacket assembly 100, which is mounted around the core 10, such as by upper and lower retaining rings 150 and 160, respectively. The retaining rings 150, 160 limit the outward radial movement of the jacket assembly.

The first 950 and second 955 bodies also have areas defined as a top end 400, and a bottom end 500. The top end 400 of the first body 950 and the bottom end of the second body 500, may have other plunger parts, plunger accessories, or other oil field components, tools, or items attached thereto. These parts can be connected by threads, welding, soldering, pins, screws, or drilled or threaded holes in both the plunger body and the other part A fishing part 420 has a head area 425 and a neck 424 of reduced diameter for engagement by a fishing tool if required. The fishing part 420 may be a separate piece threadingly connected to the top end 400 at a threaded connection 430, and also secured with a set screw, e.g. 415, and may have a wrench flat 423 to assist in loosening or tightening. Alternatively, the fishing piece 420 may be machined into the upper end 400 of the core 10. The fishing part 420 may also have an annular shoulder 421 which abuts a retaining means, such as an upper retaining ring, which is positioned next to the sealing means, such as segments, e.g., 20–23, or 46–49.

The bottom end 500 of the core 10 of the second body 955 typically also has means such as threading 435 to attach other parts. In the embodiment of FIG. 2, a plug, end piece, or end cap 840 is threadedly connected to corresponding threads 435 on the bottom end of the core 10 of the second body 955. The end cap 840 may also be provided with wrench flats 842 to aid in the engagement or disengagement of the end cap to the threaded connection, and the end cap 840 may also have a tapered end 142. A set screw 862 may also be installed into the end cap 840 and the core 10 to prevent accidental loosening or disengagement. Alternatively, the end cap 840 may be machined into the core 10 of the second body 955. The end cap 840 has a larger diameter than the core 10 to keep the retaining means, such as a lower retaining ring 850, from slipping off the core 10 if it becomes detached from the core 10. The plunger of FIG. 2 also has a double ended connector 900, with first and second ends 910, 911, respectively. The first end 910 of the connector 900 is attached to the bottom 426 of the first plunger body 950, with the second end of the connector 911 being attached to the top end 427 of the second plunger body 955. The connector 900 may also have a wrench flat 905 for loosening and tightening, and is preferably threadingly connected to the first and second plunger bodies, 950, 955. In that case, the bottom end 426 of the first plunger body 950 has external threads 952 which are threadingly connected to the first end of the connector 910, which has corresponding internal threads 953. Similarly, the first end 427 of the second plunger body 955 has external threads 954, and is attached to the second end 911 of the connector 900 which has internal threading 958 to form a threaded connection. The connector 900 may also have a plurality of holes drilled in its side, in lieu of or in addition to the threading and preferably has two sets of screws 920, 921 and 925, 926, that are used to secure the connector to the lower end of the first body 950 which has corresponding holes to receive the screws, 920, 921. The connector may be similarly threadingly connected to the upper end of the second body 955, which also has corresponding holes to receive screws 925, 926.

The second plunger body 955 is typically comprised of the same, if not identical, sealing elements as the first plunger body 950, which have the same, if not identical, characteristics of the upper set of segments on the first body, which will be fully described below. The outside of each jacket assembly serves as an external seal, and the inside of each jacket assembly comprises the internal sealing means in conjunction with the core 10. The core 10 of the second body 955 is surrounded by an external sealing means such as a flexible jacket assembly 100 comprised of a plurality of segments, e.g., 48, 47, 48, and 49 which are mounted around the core. The sealing means or elements of plunger 2 of FIG. 2 comprises at least two sets 951 and 956 of longitudinally separated segments, with the preferred embodiment having two sets which effectively form two separate jacket assemblies. In the exemplary embodiments, the upper set 951 is formed of four cylindrical segments, e.g., 46, 47, 48, 49, or 20–23. The lower set 956 is also comprised of four cylindrical segments 46, 47, 48, and 49, or 20–23. Each segment 20, 21, 22, 23, or 46–49 (see FIGS. 7–10) has substantially the same width and curve so that several segments can be placed side by side to form a flexible jacket assembly 100, which is flexible and circular, or substantially circular. The jacket assemblies 100 are mounted around the core 10, such as by retaining means such as retaining rings 150, 160, 850, and 860, respectively. Biasing means, such as springs 190 bias these segments toward their outermost position 300. The jacket assembly 100 is separated from the core 10, unless it is pushed to its most inward position.

The alignment of the segments 46–49 of the upper set of segments 951 and segments 46–49 of the lower set of segments 956 is unimportant since each set is an independent and separate sealing means or jacket assembly 100. Therefore, the sides of the segments may be longitudinally aligned, substantially aligned, or unaligned. The orientation of the upper 951 set and lower set 956 of segments which is illustrated is such that the sides of the upper set of segments 951 of the first jacket assembly are longitudinally aligned with the sides of the lower set of segments 956 of the second jacket assembly. Retaining means such as retaining rings 150 and 160, 850, and 860 are positioned at the top and bottom ends of each set of segments, or jacket assembly 100, to limit the outward radial movement of the segments. The first plunger body 950 has an upper retaining ring 150, and lower retaining ring 160, and the second plunger body 955 has an upper retaining ring 850, and a lower retaining ring 860. The retaining rings permit radial movement of each set of segments 951 and 956 between an innermost position 290, wherein the exterior surfaces of the segments have a diameter less than that of any restriction to be encountered in the tubulars T, and an outermost position 300 in which the exterior cylindrical surfaces, e.g., 51, 52, 53, 54, and 51, 52, 53, 54, sealingly engage the walls of the tubulars T. The retaining rings may be held in place by a set screw 415 which is screwed into a drilled hole 420 in the core 10. See FIGS. 20, 21.

The upper and lower ends of each segment 20–23 may have notches across the ends as in 21*c*, 23*c*, or recessed ends such as in 21*d*, 23*d*, which cooperate to fit under the retaining rings 150, 160. The upper and lower ends of the segments are inwardly tapered as in 20*a*, 21*a*, 22*a*, 23*a*, so that when the segments engage a restriction in the well tubulars T, the segments will be forced toward their most inward position. This allows the plunger to overcome the restriction and to pass through the restricted area. In their innermost position 290, the segments, e.g., 20–23 and 46–49, have a diameter less than that of any restriction to be encountered in the tubulars.

Figure 8:
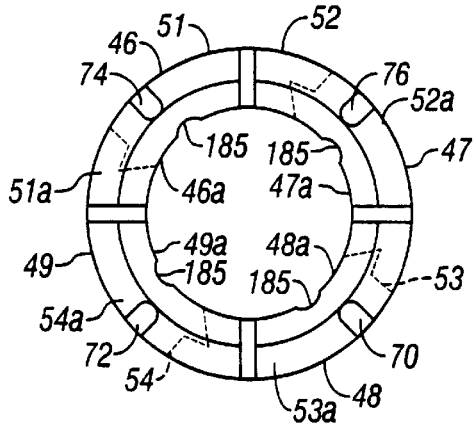
FIG. 8 is a top view of the upper end of the four segments of FIG. 7.
Figure 9:
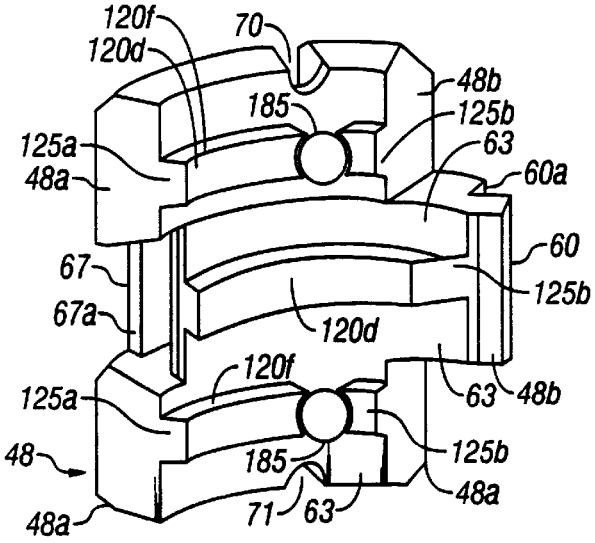
FIG. 9 is an inner, perspective view of one of the segments of FIGS. 7–8.
Figure 10:
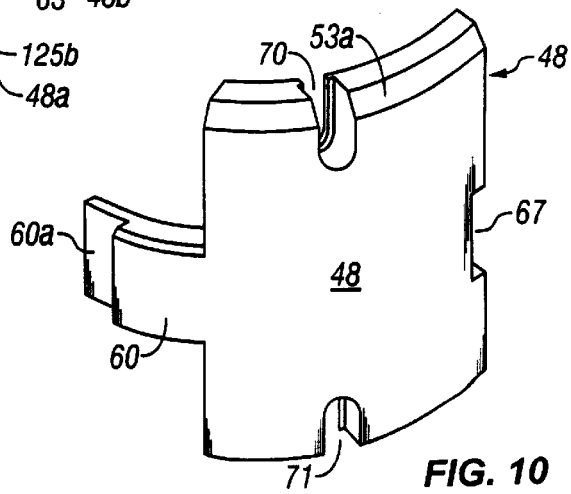
FIG. 10 is an outer perspective view of one of the segments of FIGS. 7–8.
Figure 11:
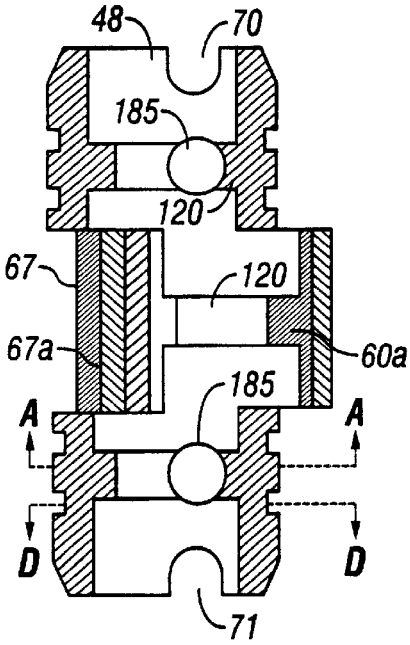
FIG. 11 is an inner planar, or flattened, perspective view of one of the segments of FIGS. 7–9.
Figure 12:
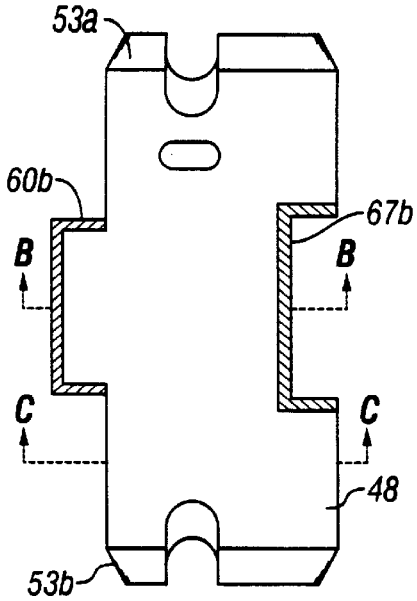
FIG. 12 is an outer planar, or flattened, perspective view of one of the segments of FIGS. 7–8, 10.
Figure 13:
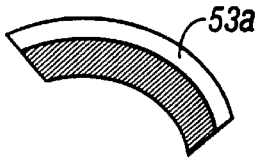
FIG. 13 is a cross-sectional view of the segments of FIGS. 7–11, taken across lines D—D of FIG. 11.
Figure 14:
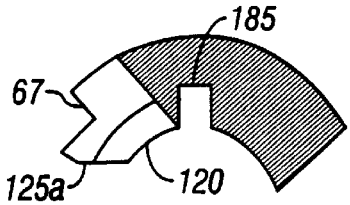
FIG. 14 is a cross-sectional view of the segments of FIGS. 7–11, taken across lines A—A of FIG. 11.

Each of the segments 46–49 and 46–49 typically have relatively smooth cylindrical surfaces on the exterior thereof for sliding and sealing contact with inner walls of the tubulars T, such as those in FIG. 1. Typically, the plunger segments are substantially rectangular. However, the segments 20, 21, 22, 23 and 46, 47, 48, 49 may be a variety of geometric shapes, sizes, and dimensions, as long as they are able to cooperate to surround the core or to form a jacket assembly 100. Each segment 4649 has substantially the same or the same width and curve so that several segments can be placed side by side. Preferably the segments 20–23, or 46–49 are made of a relatively rigid material, such as those known in the art, like metal, hard rubber, plastic, graphite, etc., and have relatively smooth outer cylindrical surfaces, due to the die cast molding of the segments, and/or polishing of the segments, for sliding and sealing contact with the walls of the well tubulars in which the plunger P is to be used, such as the inner walls of the tubulars T in FIG. 1. The segments may have straight sides as in segments 20–23, while the segments of the preferred embodiment have sides which have a tab 60 or slotted 61, 67 portion, preferably with a tab 60 on one side and a slot 61, 67 on the opposing side, as in FIGS. 7, 9 and 10. One variation of the segments 46, 47, 48, 49 of the preferred embodiment, is shown in FIGS. 7–10 and 11–17. Segment 48, is shown in inner and outer perspective views in FIGS. 9, 11 and 12, and in cross-section in FIGS. 13, 14, 15, 16, and 17. FIG. 16 is a sectional view of the segments 46–49 at section B—B, in their most inward position. For example in FIG. 7, segment 48 has a tab 60 which is engaged with slot 61 of segment 49. See also segments 46 and 47 in FIG. 16, with tabs 64, 66, respectively and slots 63, 65, respectively. The cross-section of segments 46, 47, 48, 49 as in FIG. 16, show that when the mutually engageable tabs, e.g., 60, 62, 64, 66 are interconnected with the slots, e.g., 61, 63, 65, 67 located on the sides of the adjacent segments, that a circumferential jacket assembly 100 is formed. In FIGS. 9, 10, and 14, these tabs, e.g., 60, and slots, e.g., 67, have stepped areas so that a portion of a tab 60*a* overlaps an inset portion of a corresponding slot 67*a*, 67*b*. The overlapping is accomplished with opposing surfaces, e.g., 67*a* and 60*a*, which are slidably engageable with the opposing surfaces of the adjacent segments 46–49, and which guide the segments inwardly and outwardly between their innermost and outermost radial positions. These overlapping opposing sealing surfaces are planar surfaces which are tangentially disposed relative to a cylinder whose axis corresponds with the axis of the core 100 of the plunger body about which the segments are disposed. The overlapping surfaces further minimize leakage from the flow path 200 of FIGS. 18, 19, between the core and the segments, and therefore assist in inner sealing. The unique circumferentially and mutually engageable tabs and slots and the overlapping opposing tangentially disposed planar surfaces provided by stepped areas thereon allow radial inward and outward movement while limiting leakage and erosion caused thereby. Each of these segments 46, 47, 48, 49 is provided with a convex or substantially convex outer surface 51, 52, 53, 54, respectively. The inner surfaces of the segments are typically cylindrical in shape, e.g., 46a, 47a, 48a, and 49a. However, the core of the plunger could be square, triangular, or of another geometric shape, in which case the inner surfaces of the segments could be flat, or may have another shape which corresponds to the shape of the core 10 (not shown). FIG. 8 is an upper end view of the segments 46–49.

The upper and lower ends of these segments may also be inwardly tapered as at 51*a*, 52*a*, 53*a*, 54*a*, and 51*b*, 52*b*, 53*b*, 54*b*, respectively, so that when the segments engage a restriction in the well tubulars, the segments will be forced inwardly to allow the plunger to pass through the restriction. In the preferred embodiment, the upper ends of each segment have a semi-circular notch 70, 72, 74, 76, as do the lower ends of such segments 71, 73, 75, 77, which slidably fit under the lugs, e.g., 153, 163, 164 of the retaining rings. See FIGS. 20, 21. The lower set of segments 956 which also form a jacket assembly 100 in the second body 955 also preferably have the same tabs, slots, and tapering. The jacket assemblies 100, 100 are separated from the core thereby forming a flow path 200 between the core and the underside of the jacket assemblies 100, unless the segments 46–49 and 46–49 are pushed to their most inward position 290, 290.

In addition to having at least two separate jackets for internal and external sealing, the preferred embodiment further has segments wherein the inner surface or underside possesses at least one finger 120 which is preferably made of rigid materials known to one skilled in the art, such as metal, plastic, hard rubber, graphite, and the like. See e.g., FIGS. 5, 9, 11, and 15. The rigid finger 120 of the exemplary embodiments are made of metal and are an integral part of the segment 46, 47, 48, 49 which is molded. The exemplary embodiment has three fingers 120 on the underside of each segment, respectively. See, for example, FIG. 9. Preferably, there are a plurality of rigid fingers on each segment underside, with the preferred embodiment, e.g., FIGS. 5, 9, 20, having three such fingers 120 on the underside of each segment 32, 63, respectively. The fingers 120 of each segment protrude radially inward toward the core 10 and are parallel and horizontally aligned with the fingers 120 of the adjacent segments to collectively cooperate to encircle the core 10 and the fingers 120, and serve as part of the internal sealing means. The fingers 120 and core 10 are typically separated by space, or a flow path 200, unless the fingers are pushed to their most inward position. If the core 10 has grooves, e.g., 12, 14, 16, the fingers 120 on the underside of the segments 46, 47, 48, 49 are adjacent to and aligned with the grooves 12, 14, 16, in the core 10, and fit into the grooves, 12, 14, 16. See FIGS. 20, 21. Typically during operation, the fingers 120 and grooves 12, 14, 16, are separated by a space, or flow path 200. Where both fingers and grooves are present, there is an increased surface area between the inner surface of the segments which energizes the segments and pushes the segments outwardly to cause an external seal with the tubulars.

Figure 15:
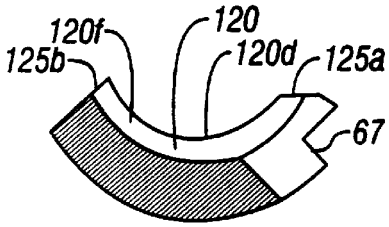
FIG. 15 is a cross-sectional view of the segments of FIGS. 7–12, taken across lines C—C of FIG. 12.
Figure 16:
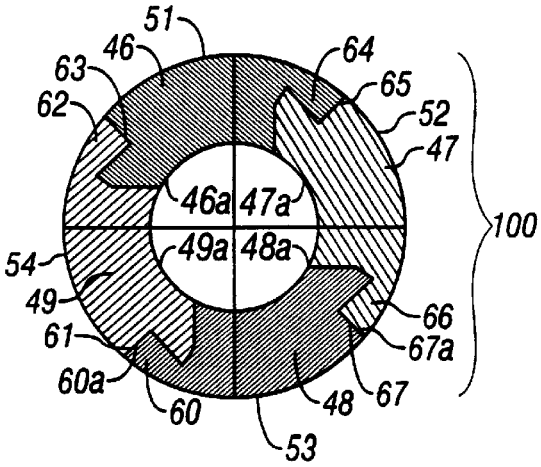
FIG. 16 is a cross-sectional view of the four segments of FIGS. 7–12, taken across lines B—B of FIG. 12.
Figure 17:
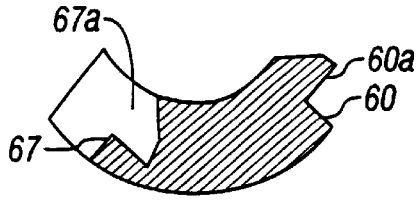
FIG. 17 is a cross-sectional view of the segments of FIGS. 7–12, taken across lines B—B of FIG. 12.

As in FIGS. 5, 9, 15, each finger 120 is defined by top 120*f* and bottom side surfaces 120*b*. The fingers 120 may be in a variety of geometric shapes. For example, the fingers 120 may have a cross section such as that of a V-shape, wherein the top and bottom sides converge (not shown), or conversely the side surfaces may diverge with respect to one another (not shown). In the preferred embodiment, the fingers 120 also have an inner surface 120*d* which is curved concave shape, which is complimentary to the shape of the core 10. However, the inner surface of the fingers 120 could also be semicircular in cross-section, with a convex inner surface (not shown). Many other variations and combinations thereof are also possible. Further, the finger has first 125*a* and second side edges 125*b* which are flat and angularly aligned with the first and second adjacent side edges of the segment, e.g., 48*a*, 48*b*, respectively. The elevation of the fingers 120 may vary. In the embodiment having a grooved core 12, 14, 16, the elevation of the fingers 120 may be at least as great as the depth e.g., 18*b* of the groove, e.g. 12, 14, 16, 18, or conversely, less than the depth of the groove 12, 14, 16. However, the fingers 120 must be of a narrower width than that of the corresponding groove, so the fingers 120 can fit into such grooves, e.g. 12, 14, 16. See FIGS. 18, 20, and 21. Further, the fingers 120 maybe of a uniform or variable elevation, shape, and width with respect to one another.

Figure 18:
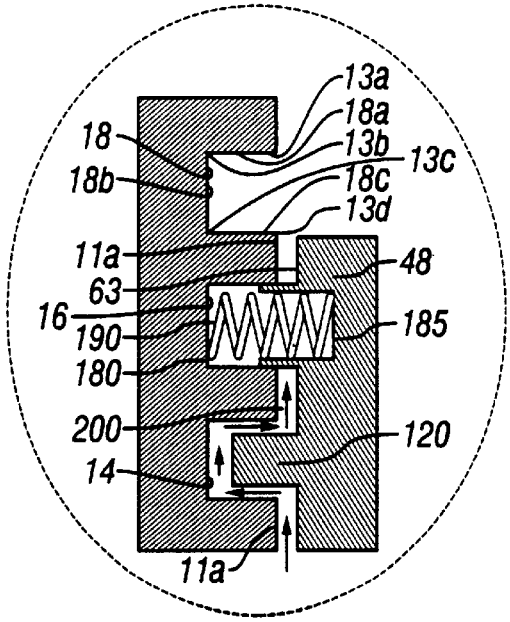
FIG. 18 is a detailed drawing, partially in section, illustrating the biasing means and the flow path of the sealing assembly of the preferred embodiments of FIGS. 2, 3, and 20, and the sectional view of a grooved core and a segment with a finger.
Figure 20:
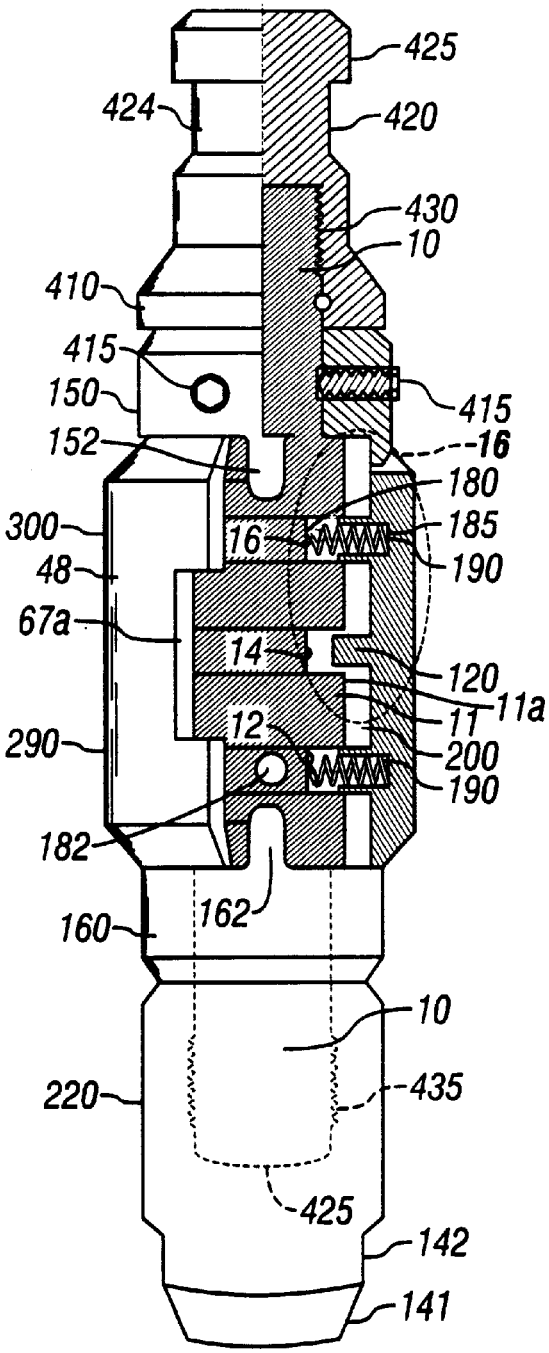
FIG. 20 is a partial view, in quarter section, of the preferred embodiment of a sealing assembly.
Figure 21:
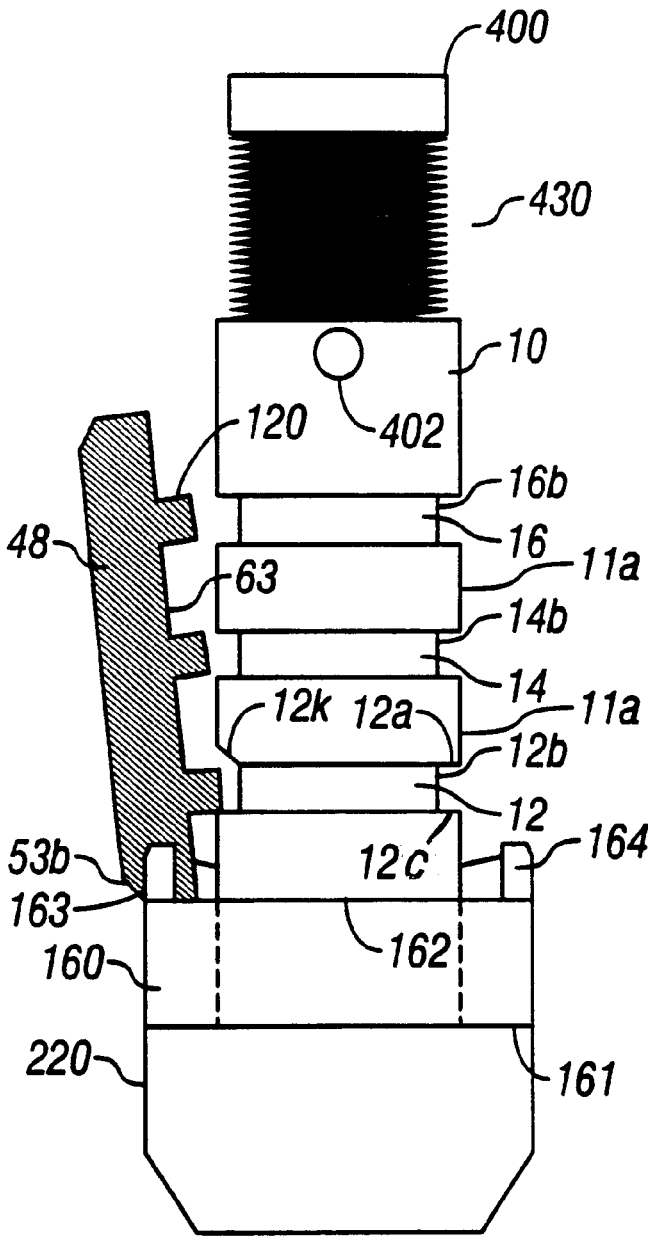
FIG. 21 is an outer perspective view of the installation of one of the segments in an embodiment with a grooved core and segments with fingers underneath a lug of a retaining ring.
Figure 22:
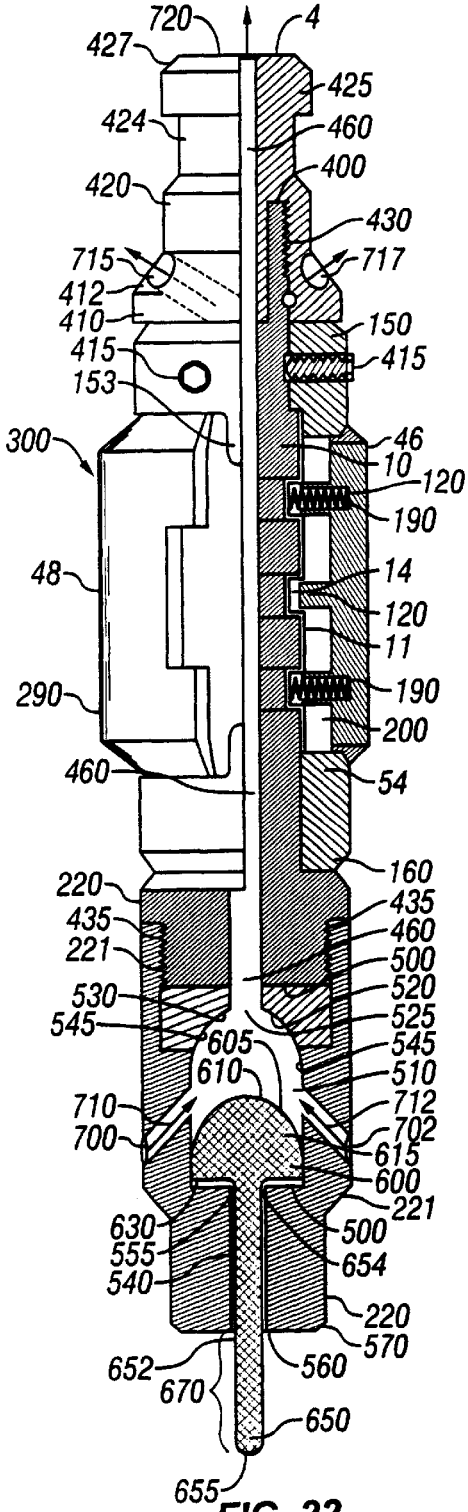
FIG. 22 is a longitudinal view, in quarter section, of a gas-operated plunger which has a chamber and an internal passage and valve closure means in the open position.
Figure 23:
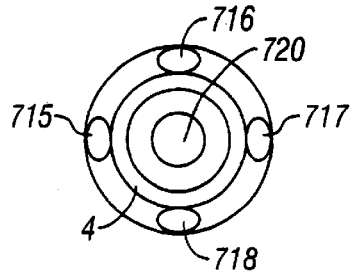
FIG. 23 is the top view of the fishing piece of the plunger of FIG. 22.
Figure 24:
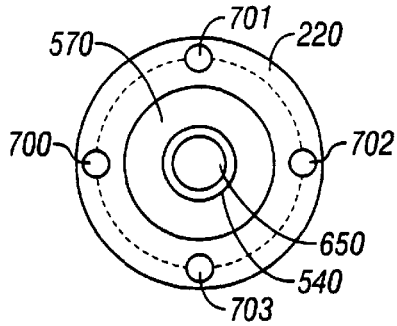
FIG. 24 is the bottom view of the plunger of FIG. 22.

As best seen in FIGS. 18, 20, the preferred embodiment has biasing means 190 disposed between the core 10 and the underside or inner surface of the segment, e.g., which biases the segment e.g., 46, 47, 48, 49 outwardly from the core 10. The biasing means may take the form of a helically wound spring 190 or leaf spring or other member which has the ability to rebound or recoil after being compressed. Further, the core 10 may possess a blind hole 180, or a blind hole 182 may be present in the core groove 185, e.g., 12, 14, 16. Preferably there are two biasing means e.g. 190 between each segment e.g. 46, 47, 48, 49 and the adjacent area of the core 10 or core groove e.g. 12, 14, 16. The biasing means 190 are preferably placed about midway across the width of the segment and at places along the length of the underside that leave the segment balanced against the core 10. The blind holes e.g., 180, 182, accommodate and hold the biasing means e.g., 190 in place. The finger of the preferred embodiment may also have a blind hole 185 which accommodates a biasing means, e.g., 190. Preferably the embodiment has a blind hole in both the core 180 or core groove 182 and the underside of the adjacent segment 185 (not shown) or finger 120. This design minimizes the risk of loss of the biasing means 190.

Alternatively, the fingers may be located on the surface of the core 11, and would be referred to as "bands" (not shown). The core may have one circumferential band, or a plurality of circumferential bands. In this case, the bands have corresponding elements and features equivalent to those found in the fingers. The bands may be found in an embodiment with or without corresponding furrows in place of the grooves on the underside of the segments (not shown). In this case, the furrows have corresponding elements and features equivalent to those found in the grooves of the core. The underside of the segments may have one furrow, or a plurality of furrows which collectively form a circumferential furrow. When there are both bands and furrows present (not shown), the bands on the surface of the core 11 (not shown) fit into the corresponding furrows on the underside of the segments (not shown). In this alternative design, there may also be biasing means between the segment and the core (not shown). The bands may be a variety of shapes and widths, similar to those described for the fingers. Preferably, the band has a flat bottom side and a flat top side and a curved outer surface. The bands may also have a variety of elevations, and may be at least as great or less than the depth of the furrow (not shown). Similar to the plurality of fingers and grooves, a plurality of bands and/or furrows create a tortuous path of flow for fluids and gases and an increased surface area between the undersides of the segments and the core which would energize the segments and push the segments outwardly to cause an outer seal with the tubulars. Further, a plurality of bands and/or furrows also provides a tortuous path of flow and effects an inner turbulent seal and retards the upward flow of fluids and gases and causing an increase in pressure below the plunger. Similar to the fingers and grooves, the biasing means may be placed between the core and the segments. Also similarly, there may be at least one blind hole in each band which accommodates a biasing means under each segment. The biasing means may also be disposed between the band and the furrow (not shown). Further, at least one furrow in each segment may have a blind hole which accommodates the biasing means with the biasing means being disposed between the band and the furrow (not shown).

Now referring back to the fingers on the underside of the segments, in the preferred embodiment, the top and bottom side surfaces 120*f*, 120*b* of the finger 120 has an angle of substantially 90 degrees, relative to the outer surface of the core 11, and has an inner surface 120*d* which is substantially parallel to the outer surface of the core 10. The finger of this design has a square or rectangular cross section. See e.g., FIGS. 5, 18, 20.

Figure 3:
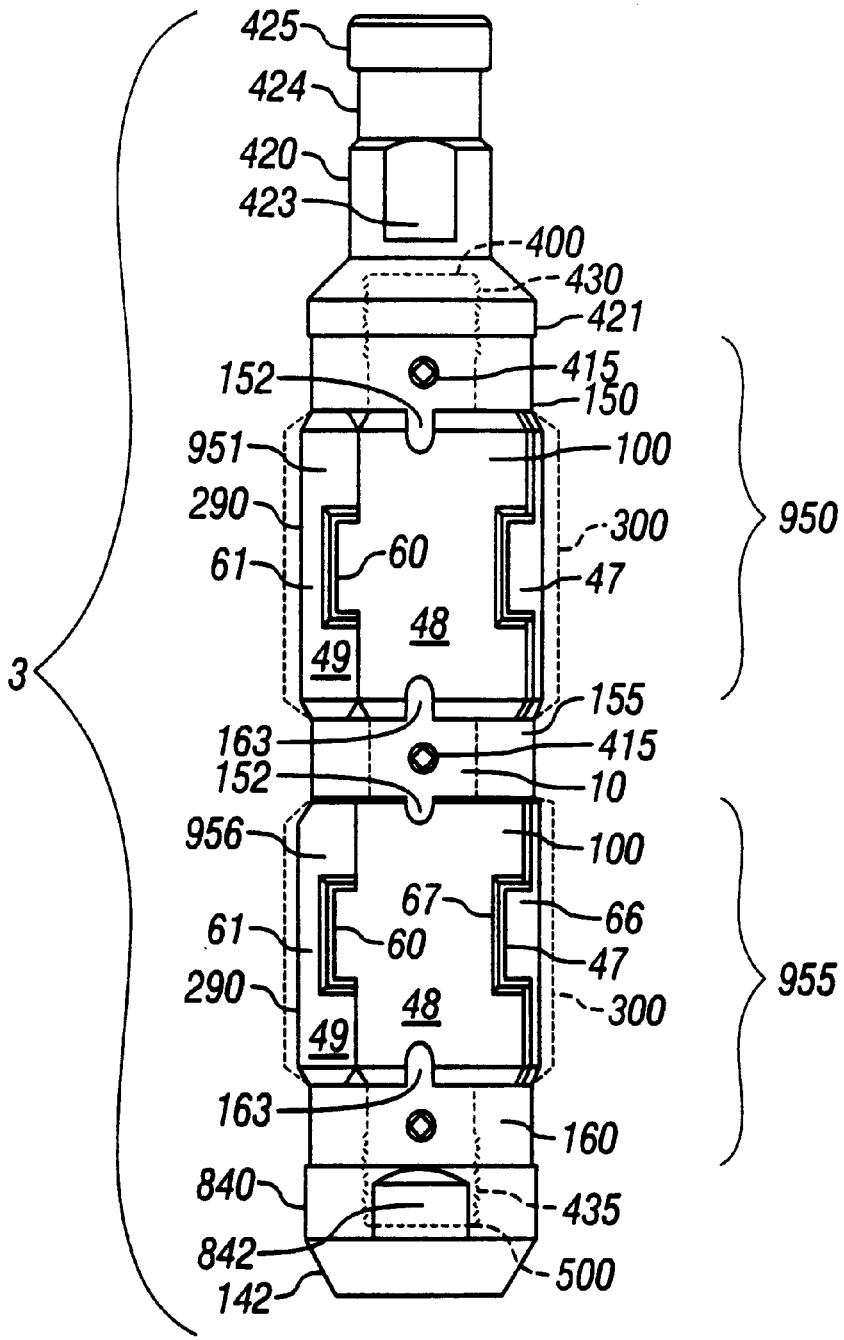
FIG. 3 is an external view of a plunger with two sealing assemblies which are mounted around one elongated core.

The core 10 of the plunger body FIGS. 2 and 3 may also possess internal sealing means such as one grove or a plurality of longitudinally spaced circumferential grooves 12, 14, 16, 18 which are defined by recessed surfaces that are interspersed between the ungrooved sections of the surface of the core 11. Each groove e.g., 12, 16, 18 is defined by a recessed surface e.g., 18*b* and upper and lower side surfaces, e.g., 18*a* and 18*c*, respectively. In the preferred embodiment, the lower surface portion 18*b* have an angle of substantially 90 degrees, relative to the outer surface of the core 11, and has upper and lower portions 18*a*, 18*c*, that have an angle of substantially 90 degrees, relative to the outer surface of the ungrooved core 11*a*. The core of this design has a square or rectangular cross sections, see e.g., FIGS. 18, 21. The preferred embodiment of the plunger has a core 10 which includes a plurality, preferably three, of longitudinally spaced circumferential grooves e.g., 12, 14, 16, that divide the peripheral surface of the core 11 into a plurality of outer surface sections e.g., 11*a*, 11*a*.

The groove or grooves may also be in the form of a spiral, or conversely in a variety of geometric shapes, and, for example, have a cross section such as that of a V-shape, or top and bottom sides that converge or diverge with respect to one another, or a semi-circular cross section (not shown). Many other variations are also possible. For example, the depth and/or length of the recesses e.g. 18*b*, may be variable, as well as the length of the body sections 11*a* between the recesses. Further, the grooves, e.g. 12, 14, may be of a uniform or variable depth, shape, and width, with respect to one another.

There is also a inner turbulent sealing effect, e.g. FIG. 5, when the embodiment has an ungrooved core and at least one, or preferably a plurality of fingers e.g., 120 which project inwardly toward the core 11. Alternatively, the finger may be replaced by band(s) on the core and would have substantially the same effect as the finger(s). There is an even more dramatic inner sealing effect where the embodiment has grooves 12, 14, 16 in the core 10, as well as projections, e.g., 120, FIG. 18, or with bands and furrows.

In an embodiment having a grooved core e.g., 12, 14, 16, fingers 120, and upper 150 and lower retaining rings 160, the bottom edge of the lowermost groove e.g., 16 of the core 10 is angularly reduced to allow installation of the segments 46, 47, 48, 49 underneath the upper retaining ring 150. Or in the alternative, the top edge 12*a* of the topmost groove e.g., 12 of the core is angularly reduced 12*k* to allow installation of the segments with fingers 120 underneath the lower retaining ring 160. See FIG. 21. Of course, the fingers 120 of the segments, e.g., 46–49, may also be present in plungers with grooved cores 12, 14, 16, with fingers interspersed in the core grooves. In that case, at least one outer top edge of one of the grooves, e.g., 12, or grooves, e.g., 12, 14, 16, is angularly reduced to allow installation of the segments underneath the retaining rings, e.g., 150, 160.

The outside of retaining rings 150, 160 are substantially cylindrical and have a hollow inner surface of a slightly larger diameter than the core 10, which enables them to slip onto either end of a cylindrical core. The retaining rings 150, 160, have first 161 and second 162 ends, with the first end 161 having a plurality of lugs, e.g. 163, 164 positioned next to the segments, and the second end 162 of the retainer ring being positioned opposite to the segment ends. Preferably, the retaining rings 150, 160 have four downwardly projecting lugs, such as lugs 163 and 164 which are spaced at ninety degree intervals around the retaining rings 150, 160 and are oriented to engage the notches 70, 72, 74, 76 at the upper ends of the segments 46, 47, 48, 49, as in FIGS. 3, 7, 9, and 10 and the lower ends of the segments, e.g., 71, 73. Alternatively, the segments e.g. 21, 23, or 48, may have a slotted e.g. 21*c*, 23*c* or notched top e.g. 70 and bottom ends e.g. 71 which slidably fit under the retaining rings, as in FIG. 4, and limit the outward radial movement of the segments, e.g. 21, 23, 48.

Referring now to FIG. 3, the operation of an additional embodiment of a plunger pump P will be explained. FIG. 3 illustrates an alternate preferred embodiment of the invention which in many respects is the same as the embodiments of FIGS. 2, 4–21. However, plunger 3 has a single elongated core 10 with an upper and lower set of segments, 951 and 956 and are mounted around one unitary core 10. The elongated core 10 is also surrounded by at least two separate flexible jacket assemblies which is also formed by a plurality of segments mounted around the core and upper and lower set of segments 951 and 956. Plunger 3 of FIG. 3 also has areas defined as a top end 400 and a bottom end 500. The top end 400, like some of the previous embodiments, is provided with a fishing piece 420, with a head area 425, and a reduced neck 424 for engagement by a fishing tool if required. The fishing piece 420, in these embodiments, is a separate piece threadedly connected to the top end at a threaded connection 430, or the fishing piece can be machined into the core 10. The bottom end 500 is provided with external threads 435 which, in cooperation with a corresponding internal thread on an end cap 840, provides a threaded connection 435 on the end cap 840 which may be machined into the core 10.

Retaining rings 150, 155, and 160 are mounted at the top and bottom ends of each set of segments to limit the outward radial movement of the segments. There is an upper retaining ring 150, a single middle retaining ring 155 with lugs on both the first and second sides 152, 153, or two middle retaining rings with lugs on one side like 150, 160 (not shown), and a lower retaining ring 160. The retaining rings 150, 160, have first 161 and second 162 ends, with the first end 161 of the upper 150, 162 lugs, e.g. 163, 164 and lower retainer ring 160 being positioned on the opposite side of the segment ends e.g. 53*b* and the second end 162 of retainer ring being positioned adjacent to the ends of the segments e.g. 48. The middle retaining ring may have lugs on both sides as shown in FIG. 3. The retaining rings may be held in place by a set screw 415, which is screwed into a drilled hole 402 in the core 10. See FIGS. 20, 21. The retaining 150, 160 rings may be held in place by a set screw 415, which is screwed into a drilled hole 402 in the core 10. See FIGS. 20, 21. Like the previously described plunger 2, plunger 3 has a body with a core 10, which is surrounded by a flexible jacket assembly 100 comprised of a plurality of segments e.g., 46, 47, 48, and 49, or 20, 21, 22, and 23 mounted around the core. Again, the segments have a convex or substantially convex outer surface 51, 52, 53, 54 and preferably have a concave or substantially concave inner surface, See e.g. FIGS. 4, 5, 6, 7, 8, and 16. However, the core of the plunger could be square, triangular, or of another geometric shape, in which case the inner surfaces of the segments could be flat. The segments have the largest diameter of the plunger in their expanded radial position 300, and are slidingly and sealingly engageable with the tubulars T based upon the pressure effected between each set of segments, e.g., 46–49 and 46–49, and the core 10. Each set of segments, 46–49 form a jacket assembly 100 around the core 10, with corresponding internal sealing means. Like in the previously described embodiment of plunger 2, plunger 3 of FIG. 3, is provided with external and internal sealing elements or means made up of a plurality of segments 46, 47, 48, 49 etc., which are substantially identical to the corresponding elements in the embodiments of FIGS. 2 and are similar to the corresponding elements in FIGS. 4–21. The sealing means or elements comprise at least two sets of segments which form separate jackets. The preferred embodiment has two sets of segments, an upper set 951 and a lower set 956, which effectively form two separate jackets. In the exemplary embodiment, the upper set 951 is formed of four identical cylindrical segments 46, 47, 48, 49. The lower set 956 also has four identical cylindrical segments 46, 47, 48, and 49.

Retaining rings 150, 155, and 160 hold these segments 46, 47, 48, and 49, collectively the jacket assembly 100, in place but permit their radial movement between an innermost position 290, in which the exterior surfaces have a diameter less than that of any restriction to be encountered in the tubulars T, and an outermost position 300 in which the exterior cylindrical surfaces e.g., 51, 52, 53, 54, slidingly and sealingly engage the walls of the well conduit in which the plunger P is to be used.

As in the embodiments previously described and shown in FIG. 2 and FIG. 421, there is an internal sealing means, such as the inner surfaces of the segments which may also have rigid fingers 120 projecting inwardly. Or alternatively, the raised surfaces are in the form of a rigid band on the surface of the core 10(not shown), and there may be furrows in the inside surface of the segments. Preferably, each segment, e.g., 46–49 has three fingers 120 on the underside of each segment which protrude radially inward toward the core 10.

As in the previous embodiments, the internal sealing means also may include a core 10, wherein the surface 11 is grooved, e.g., 12, 14, 16. Where there are both grooves 12, 14, 16, in the core 11, the fingers 120 on the segments 46, 47, 48, 49 are adjacent to and aligned with the grooves 12, 14, 16, in the core 10 and parallel and horizontally aligned with the fingers of the adjacent segments so the fingers collectively cooperate to encircle the core 10, and fit into the grooves, 12, 14, 16. The fingers 120 are typically separated from the core 10 unless the fingers are pushed to their most inward position. Typically during operation, the fingers 120 and core 10 are separated by a space, or flow path 200. This arrangement of grooves and/or finger projections, or a bands and/or furrows create a tortuous path of flow that effects an inner turbulent seal. Biasing means, such as springs 190 bias these segments toward their outermost position 300. As best seen in FIGS. 18, 20, the preferred embodiment may also have biasing means, which are typically springs 190 disposed between the core 10 and the underside or inner surface of the segment, e.g., 61, 62, 63, 64 which biases the segments e.g., 46, 47, 48, 49, outwardly from the core 10.

Referring now to FIGS. 2 and 3, the operation of a plunger pump 1 and 2 for use in a gas/fluid lift system in FIG. 1 in tubulars in wells producing both fluids and gases under variable pressure will be explained. Referring now to FIGS. 1, 2, and 3, the jacket assembly 100 is also slidingly and sealingly engageable within the well tubulars T, based upon the pressure effected by the flow path 200 between the underside of the jacket 100 and the core 10 by the gas and fluids that move upwardly between the segments 20, 21, 22, and 23, and based upon the outward biasing force of the jacket assembly against the tubulars T. The jacket assembly also has the largest diameter 300 of the plunger, when the jacket assembly 100 is in its most radially expanded position 300, when it sealingly engages the tubulars.

Figure 19:
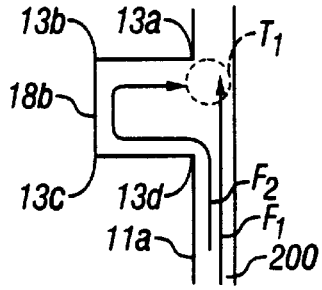
FIG. 19 is a detailed drawing, partially in section, illustrating the flow in the area between a sealing assembly with segments and grooves.

The gas below the plunger 2 and 3 must have sufficient pressure to overcome the weight of the plunger P and a liquid slug LS on top of the plunger P, and the pay line PL pressure, in order to move the plunger P up the tubulars T. Due to the necessity for clearance between the plunger P and the tubulars T which allows the plunger to fall or gravitate to the bottom of the well, a flow passage is formed between the jacket 100 and the tubulars T, and some of the gas below the plunger P will flow up between the plunger P and the tubulars T, as well as up into the plunger beneath the jacket assembly 100 and the core 10. As shown in FIGS. 18–19, once the gas and/or fluids enter into the flow path 200 between the segment 48 and the core surface 11, 11*a*, a first portion F.sub.1 of the gas flows along the surface of the core 11 and the segment underside 63, and a second portion F.sub.2 flows down and around the raised finger 120. The four right angles at each corner of the finger, 120*a*, 120*c*,

120*e*, 120*g*, and along the surfaces of the bottom 120*b* and top sides 120*f* and inner surface of the groove 120*d*, see FIG. 5, cause the first portion F.sub.1 and second portion F.sub.2 of flowing gas to meet at substantially a right angle at the corner 120*e*, creating a turbulent flow that inhibits liquid flow downward into the areas of the segment between the fingers which have lower elevations, and inhibits gas flow upward out of the segment area between the fingers. The gas flowing up along the plunger core surface 11, 11*a* dissipates energy at each successive finger, e.g., 120.

An alternate embodiment of plunger 2 has an inner passage 460 extending through each plunger body, 950, 955 and through the double ended connector 900, and a chamber 510 in the lower end in a modified end cap, and a closure means 600 disposed inside the chamber 510. Similarly, in an alternative embodiment of plunger 3, the elongated core of the body is provided with an inner passage, a chamber in the lower end in a modified end cap, and a closure means 600 disposed inside the chamber 510. The major difference between the plungers of FIGS. 22–27 and the previously described plunger of FIGS. 2 and 3 in FIGS. 4–21, is the inner passage 460 and the chamber 510 and closure means 600.

Like in the previously described embodiments, the alternate embodiments of plungers 2 and 3 of FIGS. 22–27 is provided with an external seal means made up of a plurality of segments e.g., 46, 47, 48, 49 and retaining rings. The unique circumferentially and mutually engageable tabs and slots and the overlapping opposing tangentially disposed planar surfaces provided by stepped areas, as in FIGS. 7, 8, 10, 16 thereon allow radial inward and outward movement while limiting leakage and erosion caused thereby. As in the embodiments shown in FIGS. 2–3, the alternative embodiments of these plungers, with the inner passages and chambers, also include an internal sealing means, such as the inner surfaces of the segments 61, 62, 63, 64, respectively, which may also have rigid fingers 120 projecting inwardly. Or alternatively, the raised surfaces may be in the form of a rigid band on the surface of the core 10 (not shown). Biasing means, such as springs 190, bias these segments toward their outermost position 300. As in the previous embodiments, the internal sealing means also includes a core 10, wherein the surface 11 is grooved, e.g., 12, 14, 16, on furrows on the underside of the segments. Typically during operation, the fingers 120 and core 10, or bands and grooves, are separated by a space or flow path 200. This arrangement of grooves and/or finger projections or a bands and furrows create a tortuous path of flow that effects an inner turbulent seal. As shown in FIGS. 18, 19, for illustration purposes, the gas also enters into the flow path 200 between the segment 48 and the core surface 11, 11*a*, a first portion F.sub.1 of the gas flows along the surface of the ungrooved core 11*a* and the segment underside 63, and a second portion F.sub.2 flows down into the groove e.g., 16, 18 and recessed surface e.g., 18*b*. This radius of four right angles at each corner, 13*a*, 13*b*, 13*c*, 13*d*, and along the recessed surface 18*b* and the top 18*a* and bottom sides 18*c* of the groove 18 cause the first portion F.sub.1 and second portion F.sub.2 of flowing gas to meet at substantially a right angle at the corner 13*a*, creating a turbulent flow region T.sub.1. The gas flowing up along the plunger core surface 11, 11*a* dissipates energy at each successive groove e.g., 16, 14, 12. Alternatively, the furrows may be located in the underside surfaces of the segments, e.g. 46–49 (not shown). In that situation, the furrows would have corresponding elements and features equivalent to those found in the grooves, e.g. 12, 14, 16.

The chamber 510 of these alternative embodiments which houses the closure means, such as a stopper 600, is an enlarged area within the end cap 220. As previously mentioned, the end cap 220 is threadingly connected to the lower plunger body portion 500 at the threaded connection 435. The chamber 510 has a roof 520 at the upper end with an opening 525 which communicates with the upper inner passage 460 and a floor 500 at the lower end with an opening into a bore which is typically narrower than the flow passage 460 and which houses the stem bore when the closure means is in an open position. Furthermore, there is an opening 560 at the end of the stem bore flow passage 540 at the bottom of the end cap 570, and the stem protrudes downward 670 from the body of the plunger 3 in the open position. In the preferred embodiment, the roof 520 of the chamber 510 is substantially curved 520 and has a stopper 600 with a head 615 whose top end 610 is correspondingly curved 605, like the roof 520. Alternatively, the roof 520 may be triangular in cross-section and the head of the stopper is correspondingly cone-shaped. See FIGS. 26–27. There are also other variations of additional shapes which the chamber roof and chamber floor could possess, such as a flat roof and a curved floor (not shown), and corresponding variations of the shape of the first end and second end of the stopper, such as a flat top end and a circular bottom end (not shown), which could also be operable.

Figure 25:
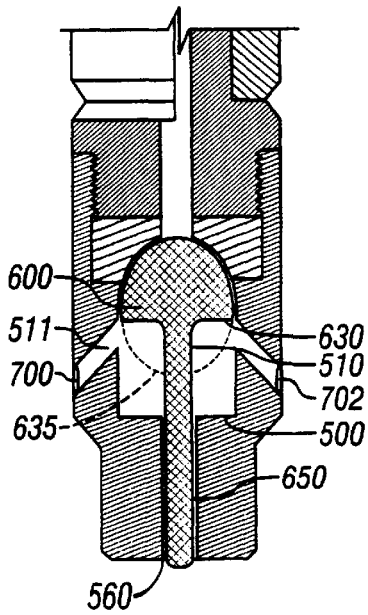
FIG. 25 is a sectional view of the chamber in the end caps of the plungers of an alternative embodiment of the plungers of FIGS. 2, 3 with the closure means in the closed position.
Figure 26:
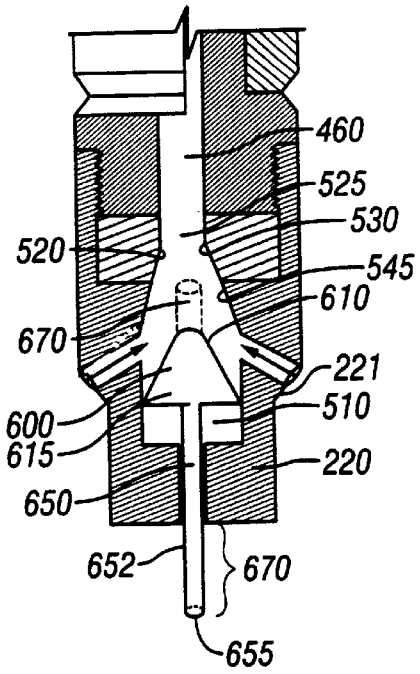
FIG. 26 is a sectional view of the chamber in the end caps of an alternate embodiment of FIGS. 2, 3 with the plunger stopper in the open position.

The roof 520 of the chamber 510 is further connected to a downwardly facing and tapered seating surface 530. The area below the seating surface 530 is also provided with an area partially defined by a slanted or tapered ramp area 545 below the seating surface 530. The seating surface 530 of the preferred embodiment is sized and designed to receive and guide a plunger stopper closure member 600 albeit rounded, half-sphere or ball-type upwardly to the seating surface 605 in the roof 520. The plunger stopper 600 has a head 615 with a top end 610 and a bottom end 630, wherein the bottom end of the stopper is substantially curved 635. Conversely, the bottom end of the stopper may be substantially flat 630. A stem 650 which is rounded and has flat sides 652 and a substantially rounded bottom 655 is attached to the bottom end 630 of the head 615. Alternatively, the top end 610 of the plunger stopper 600 may further have a stem 670 which is attached to the top end 610 of the head 615. This stem 670 will be pushed up into the inner passage 460 above the chamber 510, when the bottom end 570 of the plunger hits the bottom well stop means. (See FIGS. 26, 27) Under certain conditions, the stopper 600 is moveable between the open position of FIG. 22, in which fluid and/or gas flow is permitted into the inlet ports, e.g., 700, 702 in the end cap 220 through the chamber 510, through the hole 525 in the roof 520, through the inner passage 460, and out through the outlet ports, e.g., 715, 716, 717, 718 in the top end. In FIG. 25, the stopper 600 is in a closed position in which the fluid and/or gas flow through the chamber opening 545 into the flow passage 460 of the plunger body is blocked by the top 610 of the stopper 600. In the open position, the stem 650 extends downwardly through the opening 555 in the hole in the floor 500 of the chamber 510 into the bore 540 in the bottom of the end cap 220, and protrudes 670 from the lower end of the plunger body 570, when the plunger is descending through the tubulars T, or at the surface once the motor valve MV has been closed. When the stem 655 and then the bottom end of the plunger reach the bottom of the well, or some type of bottom well stop or well stop means, the stem 650 and stopper head 615 is forced or pushed upwardly until the top end of the head 610 is seated against the seating surface 530 of the roof 520 of the chamber 510.

Figure 27:
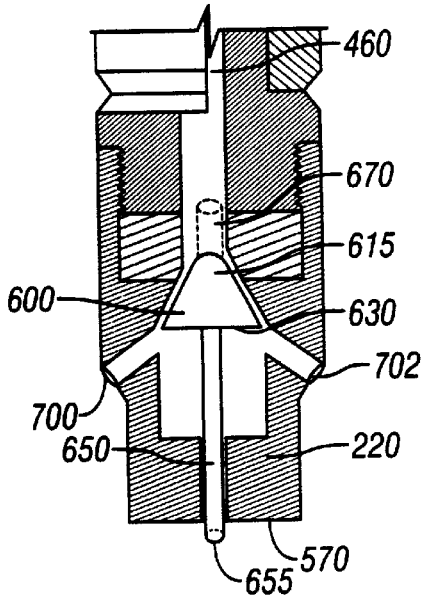
FIG. 27 is a sectional view of the chamber of an alternate embodiment of a plunger stopper in the open position.

The fishing part which is attached to the top end also has an inner passage 460. In one embodiment, the inner passage 460 has an opening 720 at the top end of the plunger. As previously discussed, the fishing part 420 may have a plurality of outlet ports 715, 716, 717, 718, or axial inner passages, disposed around the sides of the collar 410 of the fishing piece 420. Preferably, there are four radial ports, e.g., 715, 716, 717, 718 which are spaced along the cylindrical axis of the collar at about 45 degrees from each other. Similarly, there are preferably four radial ports which are spaced along the cylindrical axis of the collar at about 45 degrees from each other. The location of the inlet ports, e.g., 700, 702 in the chamber wall 511 are especially important. The ports 700, 702 are preferably located so that the inside openings of the ports 710, 712 into the chamber 510 are located above the top end 610 of the plunger stopper head 615 when the stopper is in its downward position. Furthermore, these inlet ports are preferably located so that the inside opening of the ports 710, 712 will be below the bottom end 630 of the stopper head 615 when the stopper is in its upward position, closing the inner passage 460. This placement of the inlet ports assures the bypassing of fluids through the chamber passage 510 and into inner passage 460 as the plunger falls in the tubulars T. The plunger of the embodiment of FIGS. 22–27 operates much as the plunger embodiment of FIGS. 2–5 and 6–21, and may be described with reference to FIG. 1. Like the plunger P of FIG. 1, and plungers 2 and 3 of FIGS. 2–21, the plungers 2 and 3 of FIGS. 22–27 may be placed in the tubing string T and allowed to fall or gravitate to the bottom of the well W for producing the subterranean formation F thereof. When the bottom end of the plunger 570 reaches the well stop or stop means, the stem 650 of the closure means such as the stopper 600, and the head member 615 are pushed upwardly towards the roof and to the seating surface 530 and the closure means or stopper 600 is seated against the roof 520. When the plungers 2 or 3 reach the tubing stop TS at the bottom of the tubulars, the weight of the plunger pushes against the well stop TS forcing the stopper stem 650 and head 615 in an upward direction. As soon as the closure member enters or obstructs the flow path of valve passage, the top end 610 of the stopper 600 then proceeds past the ramp area 545 and up into the seating surface 530 in the roof 520. Once the stopper 600 is seated to assume its closed position seated, the flow of fluids into the chamber through the inlet ports, e.g., 702, 710 will flow up into the chamber 510 and against the second end of the plunger head 630 will cause the stopper to assume its closed position against the seating surface 530 as illustrated in FIGS. 25, 27. At this point, the bypassing of fluid through the flow passage 460 is blocked and gas pressure is allowed to build up just as with plunger 2 and 3 of the embodiment illustrated in FIGS. 2–21. After a preselected, predetermined period of time, the control motor valve MV at the surface is opened by the controller EC and the gas pressure built up in the well causes the plunger and any well fluids accumulated in the tubulars T thereabove to be elevated to the surface and produced through the production or pay line PL. Once the plunger is detected by sensor S and the control motor valve MV closed by the controller EC, pressure is equalized in the area of the lubricating sub E. When that occurs the plunger stopper 600, due to its own weight, falls back down and reassumes its open position of FIGS. 22, 26. This opens the inner passage 460, allowing the plunger to descend to the bottom of the well W to repeat the cycle.

The plunger of the present invention has a number of unique elements. However, many variations of the invention can be made by those skilled in the art without departing from the spirit of the invention. Accordingly, it is intended that the scope of the invention be limited only by the claims which follow. Of course, the present invention is not intended to be restricted to any particular form or arrangement, or any specific embodiment disclosed herein, or any specific use, since the present invention may be modified in various ways without departing from the spirit or scope of the claimed invention herein. Furthermore, the figures of the various embodiments is intended only for illustration and for disclosure of operative embodiments and not to show all of the various forms or modifications in which the present invention might be embodied or operated. The present invention has also been described in considerable detail in order to comply with the patent laws by providing full public disclosure of at least one of its forms. However, this detailed description is not intended to limit the broad features or principles of the present invention in any way, or to limit the scope of the patent monopoly to be granted.

What is claimed is:

1. A plunger for use in a gas/fluid lift system in downhole tubulars in a wells producing fluids and/or gases under variable well pressures, comprising:

a first body and a second body slidingly engageable within the tubulars and capable of movement up and down said tubulars, said first and second body each having a top end and a bottom end and an inner core within each said body for internal sealing;

a connector disposed between said first and second bodies and joining said bodies, said connector having first and second ends, said first end attached to the bottom end of the first body and said second end attached to the top end of the second body;

a flexible jacket having an outer side and inner side, formed by a plurality of segments mounted about each said core, each of said segments having a convex outer surface and an inner surface, first and second sides, and top and bottom ends, wherein the inner surface of each segment has a plurality of fingers thereon that protrudes inward toward the core;

a tortuous flow path for well fluids and/or gases between each said core and the inner side of each said jacket;

each said jacket having an inner side providing an internal seal, and an outer side being radially expandable to provide an external seal against the interior of said tubulars, wherein each of said internal and external seals retards a flow of well fluids and/or gases which thereby increases a pressure below the plunger to thereby move the plunger and well fluids to a well surface when the well pressure inside the tubulars above the plunger is reduced.

2. The plunger of claim 1, wherein the sides of the segments of the first body are longitudinally aligned with the sides of the segments of the second body.

3. The plunger of claim 1, wherein the sides of the segments of the first body are not longitudinally aligned with the sides of the segments of the second body.

4. The plunger of claim 1, wherein the segments have first and second sides with a tab or slot, the tab or slot being mutually and slidably engageable with the corresponding tab or slot in the sides of the adjacent segments and to minimize leakage between the segments.

5. The plunger of claim 1, wherein at least one finger of each segment cooperates to encircle the core and is separated from the core unless the fingers is pushed to its most inward position.

6. The plunger of claim 5, wherein at least one finger has a flat bottom side and a flat top side, a curved concave inner surface, and first and second edges which are flat and angularly aligned with the first and second sides of the segment.

7. The plunger of claim 5, further comprising at least one circumferential groove in a surface of the core, wherein at least one finger is adjacent to the groove and fits into the groove when at least one segment with said at least one finger is pushed inwardly.

8. The plunger of claim 7, having at least one groove with at least one blind hole which accommodates a biasing means and having at least one finger adjacent to the groove with a blind hole which accommodates the same biasing means, wherein the biasing means biases the segment outwardly from the core.

9. The plunger of claim 8, wherein the first and second plunger bodies each further comprise an upper and lower retaining ring, the upper retaining ring being adjacent to the top end of the segments, and the lower retaining ring being adjacent to the bottom ends of the segments, the retaining rings limiting the outward radial movement of the segments.

10. The plunger of claim 9, wherein the interface between at least one finger and at least one groove prevents detachment or loss of the segments and/or biasing means if a retaining ring fails.

11. The plunger of claim 7, wherein at least one outer tep edge of said at least one groove is angularly reduced to allow installation of the segments with a plurality of fingers underneath said retaining rings.

12. The plunger of claim 1, having at least one circumferential groove in a surface of each core.

13. The plunger of claim 1, wherein at least one biasing means is placed between the inner surface of each segment and the core, the biasing means biasing the segments outwardly from the core.

14. The plunger of claim 1, further comprising a connector disposed between the second body and a third body, wherein the connector has first and second ends, the first end of the connector being attached to the bottom end of the second body, the second end of the connector being attached to the top end of the third body.

15. The plunger of claim 1, having an inner passage in the first and second bodies and a connector with an inner passage, for the flow of well fluids and/or gases therethrough.

16. The plunger of claim 15, wherein a well stop means is placed within the well tubulars.

17. The plunger of claim 16, further comprising an end cap attached to the bottom end of the second body, wherein the end cap has a chamber, the chamber having a roof at the upper end with an opening which communicates with the inner passage above the roof and a floor at the lower end with an opening which communicates with the bore below the floor, a plunger stopper disposed inside the chamber, the plunger stopper being moveable between an open and a closed position, the stopper having a head, the head having a first end and a second end, the first end of the head resting against the roof in the closed position, the second end resting against the chamber floor in the open position and having a stem attached thereto, the stem extending downwardly through the opening in the floor and into the bore and extending outwardly from the bottom opening at the end of the plunger, with the stem engaging the bottom well stop means when the plunger descends to the well stop means and pushing the stopper stem and the head upward, the first end of the head being seated against the roof to close the opening between the chamber and the inner passage, thereby obstructing a flow of well fluids and/or gases into the inner passage, the stopper being held against the roof by a build up of pressure below the stopper.

18. The plunger of claim 17, having a plurality of ports in the end cap for the entry of well fluids and/or gases into the chamber, the ports having an inlet opening in the outside walls of the plunger body and an outlet opening in the walls of the chamber, with a passage between the inlet and the outlet ports, the ports being located below the chamber roof and connecting to the chamber.

19. The plunger of claim 18, wherein the placement of the outlet openings of the ports in the end cap are above the first end of the stopper head when the stopper is in the open position and below the second end of the stopper head when the stopper is in the closed position.

20. The plunger of claim 17, the stopper head having a top end which has a stem attached thereto, wherein said stem is pushed into the inner passage above the chamber when the stopper is in the closed position.

21. The plunger of claim 17, having a fishing part attached to the top end of the first body, wherein the fishing part has an inner passage.

22. A plunger for use in a gas/fluid lift system in downhole tubulars in a well producing fluids and/or gases under variable well pressures, comprising:

a first body and a second body slidingly engageable within the tubulars and capable of movement up and down said tubulars, said first and second body each having a top end and a bottom end, and an inner core within each said body for internal sealing;

a connector disposed between said first and second bodies and joining said bodies, said connector having first and second ends, said first end attached to the bottom end of the first body and said second end attached to the top end of the second body;

an external sealing means having an outer side and an inner side mounted about each said core radially expandable to seal against the interior of said tubulars;

an internal sealing means disposed between or on a surface of each said core and/or the inner side of each said external sealing means, wherein the internal sealing means comprises a plurality of grooves on the core surface;

a tortuous flow path for well fluids and/or gases between each said core and the inner side of each said external sealing means;

said internal and external sealing means retarding a flow of well fluids and/or gases and causing an increase in fluid and gas pressure below the plunger which elevates the plunger and the well fluids to well surface when the well pressure inside the tubulars above the plunger is reduced.

23. The plunger of claim 22, wherein the external sealing means comprises a plurality of curved longitudinal segments mounted about said core, said segments having a convex outer surface and an inner surface, first and second sides, and top and bottom ends, said segments having the largest diameter of the plunger in an expanded radial position and being slidingly and sealingly engageable within the tubulars based upon a pressure effected between the segments and the core.

24. The plunger of claim 23, wherein the segments have first and second sides with a tab or slot, the tab or slot being mutually and slidably engageable with the corresponding tab or slot in the sides of the adjacent segments to minimize leakage between segments.

25. The plunger of claim 23, wherein the external sealing means further comprises retaining means which limits the outward radial movement of the external sealing means.

26. The plunger of claim 25, wherein the retaining means is upper and lower retaining rings, the upper retaining ring being adjacent to the top end of the segments, and the lower retaining ring being adjacent to the bottom ends of the segments, the retaining rings limiting the outward radial movement of the segments.

27. The plunger of claim 26, wherein the segments have a notch in the outer surface of the top end and a notch in the outer surface of the bottom end, and wherein the upper and lower retaining rings have a hollow inner surface and first and second ends, with the first end being placed opposite to the end of said segments and the second end of each retaining ring having at least one downwardly projecting lug which fits into each notch in said segments.

28. The plunger of claim 22, further comprising internal sealing means comprised of at least one finger on the inner surface of each segments, said finger protruding radially inward toward the core, wherein at least one finger of each said segment cooperates to encircle the core.

29. The plunger of claim 28, wherein at least one finger has a flat bottom side and a flat top side, a curved concave inner surface, and first and second edges which are flat and angularly aligned with the first and second sides of the segment.

30. The plunger of claim 28, wherein said at least one finger is adjacent to a groove and fits into the groove.

31. The plunger of claim 30, having at least one groove with at least one blind hole which accommodates a biasing means and has at least one finger adjacent to the groove with a blind hole which accommodates the same biasing means, wherein the biasing means biases the segment outwardly from the core.

32. The plunger of claim 30, wherein at least one outer edge of at least one said grooves is angularly reduced to allow installation of the segments with at least one finger underneath said retaining rings.

33. The plunger of claim 28, wherein the internal sealing means also comprises at least one biasing means disposed between the external sealing means and the core, said biasing means biasing the segment outwardly from the core.

34. The plunger of claim 22, wherein the connecting means is a double ended threaded connector with first and second ends, the first end of the connector being removably connected to the bottom end of the first body and the second end of the connector being removably attached to the top end of the second body.

35. The plunger of claim 34, having an inner passage in the first and second bodies and a connector with an inner passage, for the flow of well fluids and/or gases therethrough.

36. The plunger of claim 35, wherein a well stop means is placed within the well tubulars.

37. The plunger of claim 36, having an end cap attached to the bottom end of the second plunger body, the end cap having a chamber, the chamber having roof with an opening and a floor with an opening, with an inner flew-passage above the roof opening and a stem bore below the floor opening.

38. The plunger of claim 37, having a closure means disposed inside the chamber, the closure means being moveable between an open and a closed position, the closure means resting on the floor in the open position, and the closure means closing the opening in the roof of the chamber in the closed position, thereby obstructing a flow of well fluids and/or gases into the inner passage, the closure means being held against the roof by a build up of pressure below the closure means.

39. The plunger of claim 38, wherein the closure means is a plunger stopper, the stopper having a head, the head having a first end and a second end, the first end of the head resting against the roof in the closed position, the second end resting against the chamber floor in the open position and having a stem attached thereto, the stem extending downwardly through the opening in the floor and into the bore and extending outwardly from the bottom opening at the end of the plunger, with the stem engaging the bottom well stop means when the plunger descends to the bottom of the well tubulars and pushing the stopper stem and the head upward, the first end of the head being seated against the roof to close the opening between the chamber and the inner passage, thereby obstructing a flow of well fluids and/or gases into the inner passage, with the stopper being held against the roof of the chamber by a build up of pressure below the plunger.

40. The plunger of claim 39, wherein the top of the stopper head has a stem attached thereto, the stem being pushed up-into the inner flew-passage when the stopper is in the closed position.

41. The plunger of claim 39, having a plurality of radial-ports in the end cap for the entry of well fluids and/or gases into the chamber, the ports having an inlet opening in the outside walls of the plunger body and an outlet opening in the walls of the chamber, with a passage between the inlet and the outlet ports, the ports being located below the chamber roof and connecting to the chamber.

42. The plunger of claim 41, wherein the placement of the outlet openings of the ports in the end cap are above the first end of the plunger head when the stopper is in the open position and below the second end of the stopper head when the stopper is in the closed position.

43. The plunger of claim 39, wherein a fishing part is attached to the top end, the fishing part having an inner passage.

44. A plunger for use in a gas/fluid lift system in downhole tubulars in a wells producing fluids and/or gases under variable well pressures, comprising:

a body slidingly engageable within the tubulars and capable of movement up and down said tubulars, said body having a top end and a bottom end, and an elongated inner core within the body with a plurality of grooves thereon for internal sealing;

at least two separate flexible jackets having an outer side and inner side, formed by a plurality of segments mounted about said core, each of said segments having a convex outer surface and an inner surface, first and second sides, and top and bottom ends;

a plurality of fingers on the inner side of said segment that extend inwardly toward said core;

an upper and lower retaining ring, wherein the upper retaining ring is located at the top end of the first jacket assembly, and wherein the lower retaining ring is located at the bottom end of the second jacket assembly, said retaining rings limiting the outward radial movement of the segments;

a tortuous flow path for well fluids and/or gases between said core and the inner side of each said jacket;

each said jacket having an inner side providing an internal seal and an outer side being radially expandable to provide an external seal against the interior of said tubulars, wherein each of said internal and external seals retards a flow of well fluids and/or gases which thereby increases a pressure below the plunger to thereby move the plunger and well fluids to well surface when the pressure inside the tubulars above the plunger is reduced; and wherein said tortuous flow path is comprised of an area between the core surface and a plurality of fingers on the inner side of each said segment.

45. The plunger of claim 44, wherein the sides of the segments of the first jacket assembly are longitudinally aligned with the sides of the segments of the second jacket assembly.

46. The plunger of claim 44, wherein the sides of the segments of the first jacket assembly are not longitudinally aligned with the sides of the segments of the second jacket assembly.

47. The plunger of claim 44, wherein the segments have first and second sides with a tab or slot, the tab or slot being mutually and slidably engageable with the corresponding tab or slot in the sides of the adjacent segments to minimize leakage between segments.

48. The plunger of claim 44, with at least one finger of each segment cooperating to encircle the core and being separated from the core unless the fingers is pushed to its most inward position.

49. The plunger of claim 48, wherein at least one finger has a flat bottom side and a flat top side, a curved concave inner surface, and first and second edges which are flat and angularly aligned with the first and second sides of the segment.

50. The plunger of claim 44, having at least one circumferential groove in the surface of the core, wherein at least one finger is adjacent to said at least one groove and fits into the groove.

51. The plunger of claim 50, having at least one groove with at least one blind hole which accommodates a biasing means and has at least one finger adjacent to the groove with a blind hole which accommodates the same biasing means, wherein the biasing means biases the segment outwardly from the core.

52. The plunger of claim 51, further comprising at least one middle retaining ring, wherein said at least one middle retaining ring is located between said jacket assemblies.

53. The plunger of claim 52, wherein the interface between at least one finger and at least one groove prevents detachment or loss of the segments and/or biasing means if a retaining ring fails.

54. The plunger of claim 50, wherein at least one outer edge of one of said grooves is angularly reduced to allow installation of the segments with a plurality of fingers underneath the retaining rings.

55. The plunger of claim 44, wherein at least one biasing means is placed between the inner surface of each segment and the core, the biasing means biasing the segments outwardly from the core.

56. The plunger of claim 44, having an inner passage in the body and a connector with an inner passage, for the flow of well fluids and/or gases.

57. The plunger of claim 56, wherein a well stop means is placed within the well tubulars.

58. The plunger of claim 57, further comprising an end cap near the bottom end of said body wherein the end cap has a chamber, the chamber having a roof at the upper end with an opening which communicates with the inner flew-passage above the roof and a floor at the lower end with an opening which communicates with the bore below the floor, a plunger stopper disposed inside the chamber, the plunger stopper being moveable between an open and a closed position, the stopper having a head, the head having a first end and a second end, the first end of the head resting against the roof in the closed position, the second end resting against the chamber floor in the open position and having a stem attached thereto, the stem extending downwardly through the opening in the floor and into the bore and extending outwardly from said bottom opening at the end of the plunger, with the stem engaging the bottom well stop means when the plunger descends to the bottom of the well tubulars and pushing the stopper stem and the head upward, the first end of the head being seated against the roof to close the opening between the chamber and the inner passage, thereby obstructing a flow of well fluids and/or gases into the inner passage, the stopper being held against the roof by a build up of pressure below the stopper.

59. The plunger of claim 58, having a plurality of radial-ports in the end cap for the entry of well fluids and/or gases into the chamber, the ports having an inlet opening in the outside walls of the plunger body and an outlet opening in the walls of the chamber, with a passage between the inlet and the outlet ports, the ports being located below the chamber roof and connecting to the chamber.

60. The plunger of claim 59, wherein the placement of the outlet openings of the ports in the end cap are above the first end of the stopper head when the stopper is in the open position and below the second end of the stopper head when the stopper is in the closed position.

61. The plunger of claim 58, having at stopper head with a top end which has a stem attached thereto, wherein said stem is pushed into the inner passage above the chamber when the stopper is in the closed position.

62. The plunger of claim 58, wherein a fishing part is attached to the top end of the first body, the fishing part having an inner passage.

63. A plunger for use in a gas/fluid lift system in tubulars in a wells producing both fluids and gases under variable well pressures, comprising:

a body that is slidingly engageable and which gravitates within the tubulars, said body having a top end, and a bottom end, and an elongated internal core within the body for internal sealing;

at least two separate external sealing means mounted around said core having an outer side and inner side, radially expandable to seal against the interior of said tubulars;

an internal sealing means disposed on said core and/or the inner side of each said external sealing means;

retaining means for each external sealing means, the retaining means being located between each external sealing means, at the top end of the first external sealing means, and at the bottom end of the second external sealing means, said retaining means limiting the outward radial movement of said external sealing means;

a tortuous flow path for well fluids and/or gases between said core and the inner side of each said external sealing means wherein the inner surface of the external sealing means has a plurality of fingers thereon that protrude inwardly toward the core; said internal and external sealing means retarding a flow of well fluids and/or gases and causing an increase in fluid and gas well pressure below the plunger which elevates the plunger and the well fluids to a well surface when a pressure inside the tubulars above the plunger is reduced.

64. The plunger of claim 63, the external sealing means comprises a plurality of longitudinal segments mounted around said core and forming a flexible jacket assembly, said sealing means including at least two separate assemblies, said segments having a convex outer surface and an inner surface, said segments having the largest diameter of the plunger in an expanded radial position and being slidingly and sealingly engageable with the tubulars based upon a pressure effected between the segments and the core.

65. The plunger of claim 64, wherein the sides of the segments of the first jacket assembly are longitudinally aligned with the sides of the segments of the second jacket assembly.

66. The plunger of claim 64, wherein the sides of the segments of the first jacket assembly are not longitudinally aligned with the sides of the segments of the second jacket assembly.

67. The plunger of claim 64, wherein the segments have first and second sides with a tab or slot, the tab or slot being mutually and slidably engageable with the corresponding tab or slot in the sides of the adjacent segments to minimize leakage between of the segments.

68. The plunger of claim 67, wherein at least one finger has a flat bottom side and a flat top side, a curved concave inner surface, and first and second edges which are flat and angularly aligned with the first and second sides of the segment.

69. The plunger of claim 64, wherein at least one finger of each said segment cooperates to encircle the core and is separated from the core unless the fingers is pushed to its most inward position.

70. The plunger of claim 69, wherein the internal sealing means further comprises at least one circumferential groove on a surface of the core, wherein at least one finger is adjacent to the groove and fits into the groove.

71. The plunger ofclaim 70, wherein the internal sealing means further comprises at least one biasing means disposed between the inner surface of external sealing means and the core, said biasing means biasing the segment outwardly from the core.

72. The plunger of claim 70, having at least one groove with at least one blind hole which accommodates a biasing means and has at least one finger adjacent to the groove with a blind hole which accommodates the same biasing means, wherein the biasing means biases the segment outwardly from the core.

73. The plunger of claim 70, wherein at least one outer edge of least one said grooves is angularly reduced to allow installation of the segments with a plurality of fingers underneath said retaining rings.

74. The plunger of claim 64, wherein the retaining means comprises retaining rings which limits the outward radial movement of the external sealing means.

75. The plunger of claim 74, wherein the retaining means is upper, middle and lower retaining rings, the upper retaining ring being adjacent to the top end of the first jacket assembly, the middle retaining ring being disposed between said first and second jacket assemblies, and the lower retaining ring being adjacent to the bottom end of the second jacket assembly, the retaining rings limiting the outward radial movement of the segments.

76. The plunger of claim 75, wherein the segments have a notch in the outer surface of the top end and a notch in the outer surface of the bottom end, and wherein the upper and lower retaining rings have a hollow inner circular surface and first and second ends, with the first end being placed opposite to said segments and the second end of each retaining ring having at least one downwardly projecting lug which fits into each notch in the segments, and wherein the middle retaining ring has a hollow inner circular surface and first and second ends with at least one downwardly projecting lug on each end which fits into each notch in said segments.

77. The plunger of claim 74, having two middle retaining rings with a hollow inner circular surface and first and second ends, with the first ends being placed next to one another and the second end of each retaining ring having at least one downwardly projecting lug which fits into each notch in said segments wherein the second end of each retaining ring further has at least one downwardly projecting lug which fits into the notch at the top and bottom ends of each segment.

78. The plunger of claim 63, wherein the internal sealing means further comprises at least one circumferential groove on a surface of the core.

79. The plunger of claim 63, having an inner passage in said body for the flow of well fluids and/or gases.

80. The plunger of claim 79, wherein a well stop means is placed within the well tubulars.

81. The plunger of claim 80, having an end cap attached to the bottom end of said plunger body, the end cap having a chamber, the chamber having roof with an opening and a floor with an opening, with an inner passage above the roof opening and a stem bore below the floor opening.

82. The plunger of claim 81, having a closure means disposed inside the chamber, the closure means being moveable between an open and a closed position, the closure means resting on the floor in the open position, and the closure means closing the opening in the roof of the chamber in the closed position, thereby obstructing the a flow of well fluids and/or gases into the inner passage, the closure means being held against the roof by a build up of pressure below the stopper.

83. The plunger of claim 82, wherein the closure means is a plunger stopper, the stopper having a head, the head having a first end and a second end, the first end of the head resting against the roof in the closed position, the second end resting against the chamber floor in the open position and having a stem attached thereto, the stem extending downwardly through the opening in the floor and into the bore and extending outwardly from the bottom opening at the end of the plunger, with the stem engaging the bottom well stop means when the plunger descends to the bottom of the well tubulars and pushing the stopper stem and the head upward, the first end of the head being seated against the roof to close the opening between the chamber and the inner passage, thereby obstructing flow of well fluids and/or gases into the inner passage, with the stopper being held against the roof of the chamber by a build up of pressure below the plunger.

84. The plunger of claim 83, having a plurality of ports in the end cap for the entry of well fluids and/or gases into the chamber, the ports having an inlet opening in the outside walls of the plunger body and an outlet opening in the walls of the chamber, with a passage between the inlet and the outlet ports, the ports being located below the chamber roof and connecting to the chamber.

85. The plunger of claim 84, wherein the placement of the outlet openings of the ports in the end cap are above the first end of the plunger head when the stopper is in the open position and below the second end of the stopper head when the stopper is in the closed position.

86. The plunger of claim 83, wherein the top of the stopper head has a stem attached thereto, the stem being pushed into the inner passage when the stopper is in the closed position.

87. The plunger of claim 83, wherein a fishing part is attached to the top end, the fishing part having an inner passage.

* * * * *